US006777149B2

(12) United States Patent
Ikegami et al.

(10) Patent No.: US 6,777,149 B2
(45) Date of Patent: Aug. 17, 2004

(54) ELECTROPHOTOGRAPHIC IMAGE FORMING APPARATUS AND PROCESS CARTRIDGE, AND ELECTROPHOTOGRAPHIC PHOTORECEPTOR THEREFOR

(75) Inventors: Takaaki Ikegami, Shizuoka-ken (JP); Akihiro Sugino, Shizuoka-ken (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/104,078

(22) Filed: Mar. 25, 2002

(65) Prior Publication Data

US 2003/0059693 A1 Mar. 27, 2003

(30) Foreign Application Priority Data

Mar. 23, 2001 (JP) ..... 2001-086067

(51) Int. Cl.[7] ..... G03G 5/14

(52) U.S. Cl. ..... 430/59.2; 430/59.1; 430/60; 430/64; 430/65; 399/159

(58) Field of Search ..... 430/59.2, 59.1, 430/60, 64, 65; 399/159

(56) References Cited

U.S. PATENT DOCUMENTS

| | | | | |
|---|---|---|---|---|
| 4,740,441 | A | | 4/1988 | Otomura et al. |
| 4,942,104 | A | | 7/1990 | Kitajima et al. |
| 5,028,502 | A | | 7/1991 | Yuh et al. |
| 5,100,453 | A | | 3/1992 | Richards |
| 5,215,839 | A | * | 6/1993 | Yu ..... 430/58.05 |
| 5,286,588 | A | | 2/1994 | Suzuki |
| 5,339,138 | A | | 8/1994 | Mishima et al. |
| 5,411,827 | A | | 5/1995 | Tamura et al. |
| 5,496,671 | A | | 3/1996 | Tamura et al. |
| 5,561,016 | A | | 10/1996 | Suzuki et al. |
| 5,578,405 | A | | 11/1996 | Ikegami et al. |
| 5,665,500 | A | | 9/1997 | Suzuki |

(List continued on next page.)

FOREIGN PATENT DOCUMENTS

| | | |
|---|---|---|
| JP | 3-146958 | 6/1991 |

*Primary Examiner*—Mark A. Chapman
(74) *Attorney, Agent, or Firm*—Oblon, Spivak, McClelland, Maier & Neustadt, P.C.

(57) ABSTRACT

An image forming apparatus including at least an image irradiator configured to irradiate a photoreceptor with a coherent light beam while scanning to form pixel light spots thereon for forming an electrostatic latent image thereon, wherein the light spots overlap with adjacent light spots; and an image developer configured to develop the electrostatic latent image with a developer, wherein the photoreceptor comprises an intermediate layer located overlying an electroconductive substrate, a charge generation layer located overlying the intermediate layer and a charge transport layer located overlying the charge generation layer, wherein the charge generation layer satisfies the following relationship:

$$T1 \leqq 3.5\%$$

wherein T1 represents a relative mirror reflectance of the charge generation layer against the coherent light beam when the coherent light beam irradiates the charge generation layer at an incident angle of 5°.

21 Claims, 6 Drawing Sheets

U.S. PATENT DOCUMENTS 5,677,096 A 10/1997 Suzuki
5,702,855 A 12/1997 Ikegami et al.
5,789,128 A 8/1998 Adachi et al.
5,834,145 A 11/1998 Yoshinaga et al.
5,846,680 A 12/1998 Adachi et al.
5,910,561 A 6/1999 Adachi et al.
5,928,828 A 7/1999 Suzuki
5,942,363 A 8/1999 Tanaka et al.
5,965,311 A * 10/1999 Suzuki ..... 430/60
5,999,773 A 12/1999 Yasutomi et al.
6,026,262 A 2/2000 Kinoshita et al.
6,030,736 A 2/2000 Ikegami et al.
6,069,224 A 5/2000 Adachi et al.
6,074,794 A 6/2000 Fushimi et al.
6,136,483 A 10/2000 Suzuki et al.
6,183,926 B1 2/2001 Kuroda et al.
6,191,249 B1 2/2001 Tanaka et al.
6,212,351 B1 4/2001 Kawagoe et al.
6,249,304 B1 6/2001 Sawayama et al.
6,258,502 B1 7/2001 Nakamura et al.
6,269,228 B1 7/2001 Kayahara et al.
6,303,258 B1 10/2001 Katoh et al.
6,319,878 B1 11/2001 Ina et al.
6,322,940 B1 11/2001 Nishigaki et al.
6,326,112 B1 12/2001 Tamura et al.
6,331,371 B1 * 12/2001 Matsui ..... 430/65
6,363,229 B1 3/2002 Shiraishi et al.
6,366,751 B1 4/2002 Shakuto et al.
6,405,002 B2 6/2002 Ogiyama et al.
6,432,596 B2 8/2002 Ikuno et al.
6,444,387 B2 9/2002 Ri et al.
6,445,900 B2 9/2002 Fukao et al.
6,449,453 B1 9/2002 Motohashi
6,492,079 B2 12/2002 Shimada et al.
6,505,024 B2 1/2003 Kayahara et al.

* cited by examiner

ELECTROPHOTOGRAPHIC IMAGE FORMING APPARATUS AND PROCESS CARTRIDGE, AND ELECTROPHOTOGRAPHIC PHOTORECEPTOR THEREFOR

BACKGROUND OF THE INVENTION

1. Field of the Invention

The present invention relates to an electrophotographic image forming apparatus and a process cartridge as well as an electrophotographic photoreceptor used for copiers and printers using coherent light as the light sources.

2. Discussion of the Background

Recently, a printer having a laser diode as the light source is widely used because of its compactness, high reliability, high-speed printing and high image quality. However, a photoreceptor which is sensitive to infrared light is desired because the laser diode has a wavelength of from 780 to 830 nm. As such photoreceptors, inorganic photoreceptors formed from cadmium sulfide doped with copper, indium, etc. and from selenium including increased tellurium have been used. However, organic photoreceptors are prevailing recently in view of the low pollution high productivity, stable quality and low cost. Among the organic photoreceptors, particularly a functionally-separated multilayer photoreceptor having a charge generation layer and a charge transport layer attracts attention in view of the high sensitivity and high durability because the materials can be flexibly selected.

The charge generation layer of the multilayer photoreceptor generates a charge by absorbing light, and the thickness of the layer is typically 0.01 to 5 $\mu$m for shortening the carrying range of the photo-carrier to prevent the recombination and the trap thereof.

In addition, a charge transport layer which scarcely absorbs imagewise light is typically used in view of the sensitivity.

Generally, the light volume which is absorbed in the photosensitive layer has a limit. The imagewise light coming in the photosensitive layer is not all absorbed therein, and some of the light reach the substrate and reflect on the surface thereof. The reflected light comes in the photosensitive layer again, and interferes with the imagewise light and the light reflecting on the surface of the photosensitive layer. Such a phenomenon remarkably occurs when the imagewise light is a coherent laser beam, causing image-density irregularity when a solid image and a half tone image are produced.

In order to prevent such a light interference, there is a method, in which an intermediate layer, including a resin containing a dispersed pigment having a large refraction index and an average particle diameter of from about 0.2 $\mu$m to 5 $\mu$m, is formed between the substrate and the photosensitive layer to scatter the light and prevent the mirror reflection. However, such an intermediate layer cannot completely prevent the light interference when the imagewise light volume and the developing condition change, and when a minimization of the diameter of the imagewise light and a high-density writing are desired for a higher image quality On the other hand, a non-cut aluminium tube is considered instead of a conventional cut aluminium tube recently in view of the manufacturing cost and the adherence to the photosensitive layer. However, the non-cut aluminium tube has a surface having a high smoothness and a high reflectance, and has the opposite effect to the light interference.

SUMMARY OF THE INVENTION

Accordingly, an object of the present invention is to provide an electrophotographic image forming apparatus preventing the image-density irregularity due to the light interference.

Briefly this object and other objects of the present invention as hereinafter will become more readily apparent can be attained by an image forming apparatus including at least an image irradiator configured to irradiate a photoreceptor with a coherent light beam while scanning to form pixel light spots thereon for forming an electrostatic latent image thereon, wherein the light spots overlap with adjacent light spots; and an image developer configured to develop the electrostatic latent image with a developer, wherein the photoreceptor comprises an intermediate layer located overlying an electroconductive substrate, a charge generation layer located overlying the intermediate layer and a charge transport layer located overlying the charge generation layer, wherein the charge generation layer satisfies the following relationship:

$$T1 \leqq 3.5\%$$

wherein T1 represents a relative mirror reflectance of the charge generation layer against the coherent light beam when the coherent light beam irradiates the charge generation layer formed on the intermediate layer at an incident angle of 5°.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides an electrophotographic image forming apparatus preventing the image-density irregularity due to the light interference.

In an electrophotographic device, an image irradiation is performed by irradiating coherent light, in which an interval between a coherent light spot and an adjacent coherent light spot is smaller than the diameter of the coherent light, namely there is an overlapped portion between the coherent light spot and the adjacent coherent light spot. The present inventors found that the overlapped portion is a cause of the image-density irregularity in case of the above-mentioned irradiation. Particularly, when the overlapped area becomes large in proportion to high image resolution, the inventors found that the light interference affects the image-density irregularity far more than considered. As a result of the inventors' investigation, it was found that the image-density irregularity due to the light interference in the photoreceptor including an intermediate layer between the substrate and the photosensitive layer occurs when the relative mirror reflectance of the charge generation layer against the coherent light when the coherent light irradiates the charge generation layer formed on the intermediate layer at an incident angle of 5°is greater than 3.5%, and that the image-density irregularity can be prevented when the relative mirror reflectance is not greater than 3.5%.

In addition, as a result of the inventors' further investigation, it was found that when a photoreceptor including at least an intermediate layer, a charge generation layer and charge transport layer has the intermediate layer and the charge generation layer satisfying the following relationship, the image-density irregularity can be more effectively prevented.

$$T1 \leqq T2 \leqq 3.5\%$$

wherein T1 represents a relative mirror reflectance of the charge generation layer; and T2 represents a relative mirror reflectance against the coherent light when the coherent light irradiates the intermediate layer at an incident angle of 5°.

A photoreceptor having the relative mirror reflectance of the present invention is particularly effective for an electrophotographic device in which the diameter of the pixel light spots is not greater than 40 $\mu$m and the overlapped area is not less than 50% of the area of each of the light spot. The diameter of the pixel light spots is preferably not greater than 25 $\mu$m.

Intervals and Diameter of the Coherent Light Spots

Figure 1:
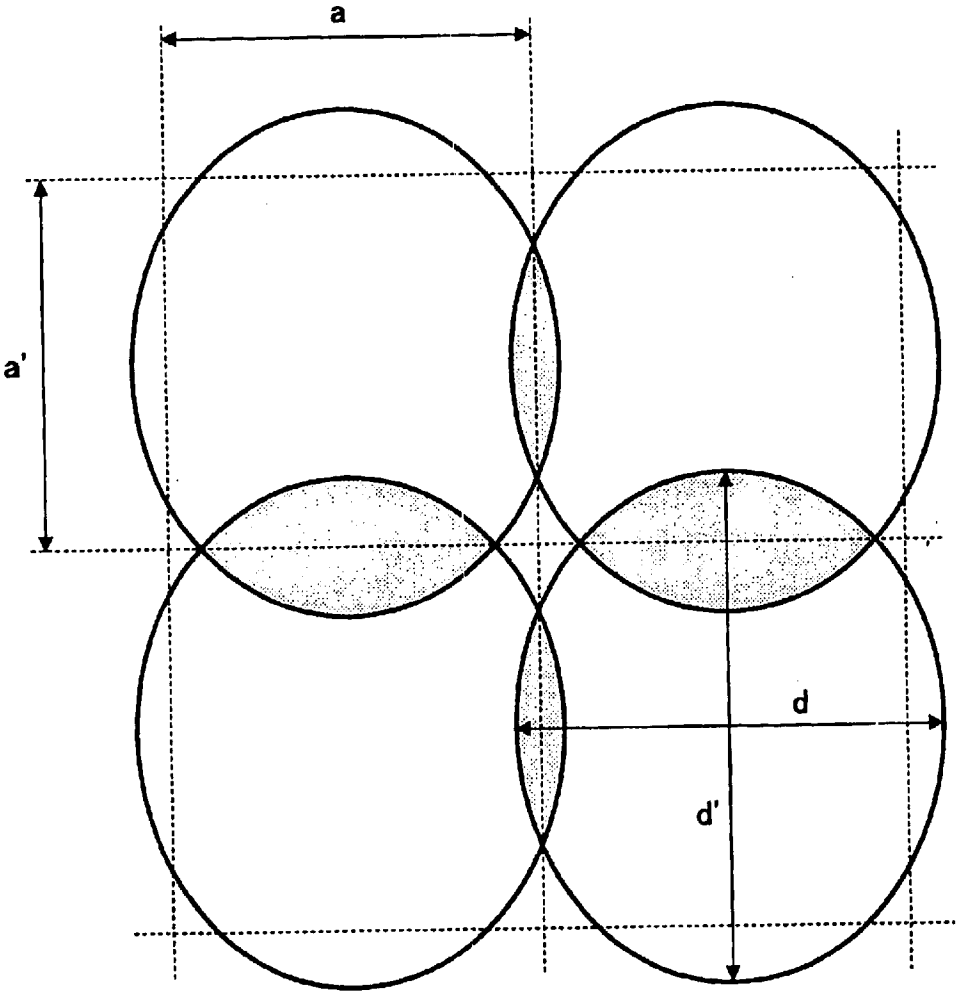
FIG. 1 is a schematic view illustrating a relationship between the coherent light spots.
Figure 2:
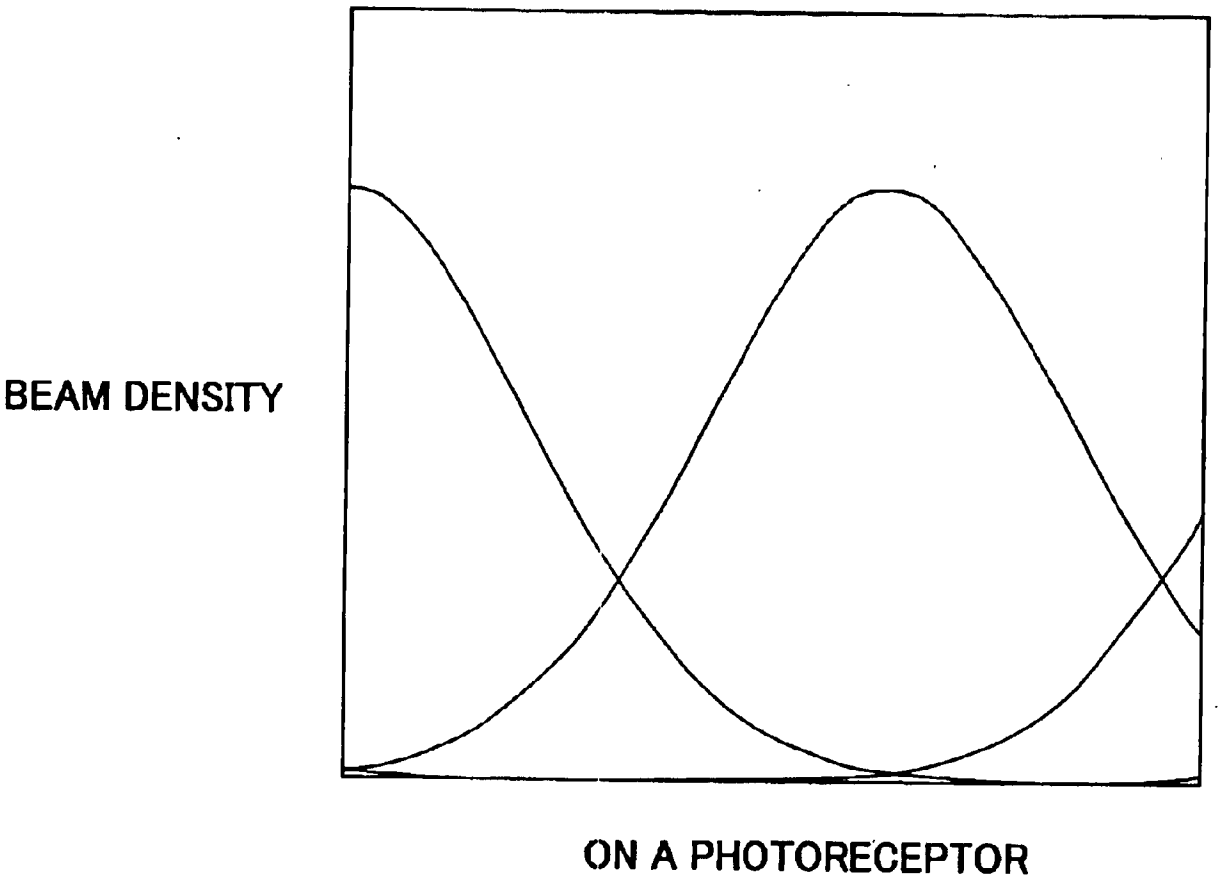
FIG. 2 is a graph showing a relationship between a coherent light beam and an adjacent coherent light beam.

FIG. 1 is a schematic view illustrating a relationship between the coherent light spots, and FIG. 2 is a graph showing a relationship between a coherent light beam and an adjacent coherent light beam.

The intervals (a and a') between the coherent light spots is determined depending on the density (writing resolution) of a latent image formed by the coherent light. The coherent light diameter (d and d') is defined as an area in which the light energy is $\alpha/e^2$ or more when $\alpha$ is a peak energy of the coherent light having a Gauss distribution.

Relative Mirror Reflectance

Figure 3:
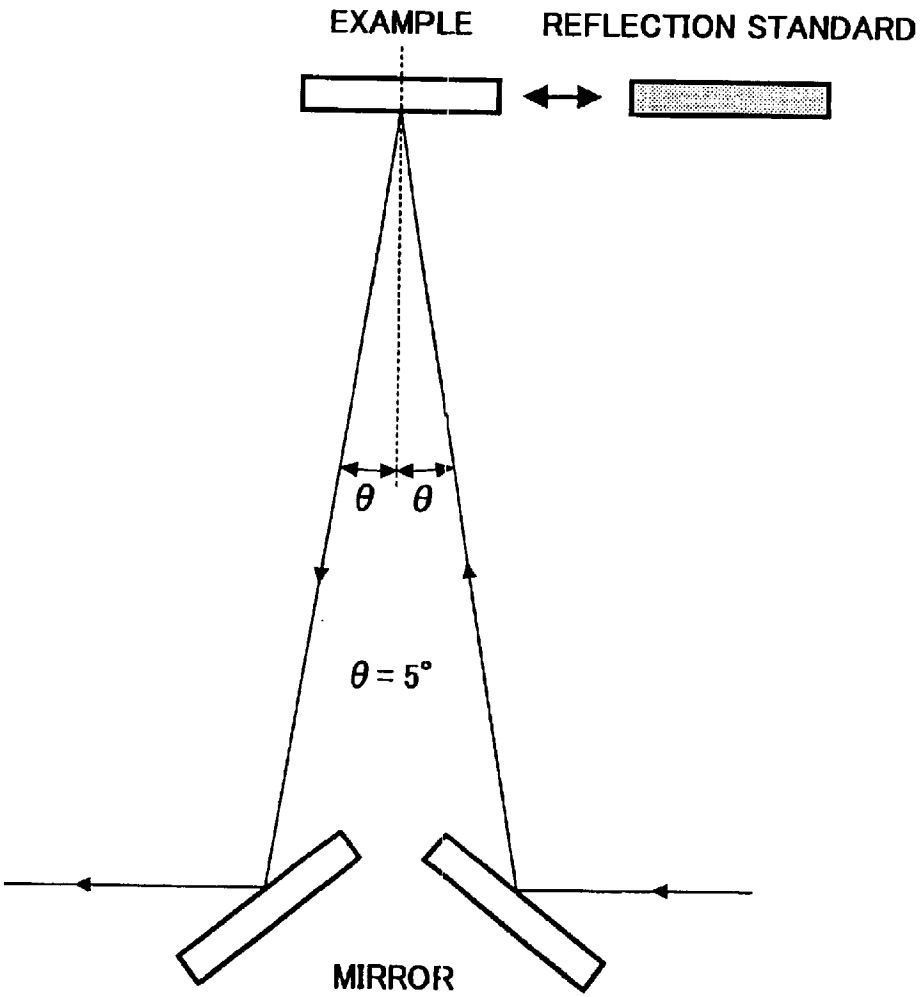
FIG. 3 is a measuring principle of the relative mirror reflectance.

The relative mirror reflectance against the coherent light having an incident angle of 5° can be typically measured by a measuring device based on the measuring principle as shown in FIG. 3. An aluminium-deposited mirror having a stable spectral reflectance is preferably used as a reflection standard.

In principle, from about 5 to 60° can be selected as the incident angle. However, when the incident angle becomes large, scattered light increases and a precise judgement cannot be made for the object of the present invention.

In the present invention, T1 is preferably not greater than 3.0%, and more preferably not greater than 2.5%. T2 is preferably not greater than 3.5%, and more preferably not greater than 3.0%.

Intermediate Layer

The intermediate layer of the present invention preferably includes a resin containing a dispersed pigment having a large refractive index. Known pigment powders can be used for the dispersed pigment particulate powder. However, white powders or others which are similar thereto are preferable in consideration of the high sensitivity of the resultant photoreceptor. Specific examples of such powders include metal oxides such as titanium oxide, zinc oxide, tin oxide, indium oxide, zirconium oxide, alumina and silica. These are preferably used because they are not hygroscopic and do not change much in quality due to change of the environment. Particularly, the titanium oxide having a good refractive index and electrical properties is preferably used.

In addition, as a binder resin for the intermediate layer of the present invention, appropriate resins can be used. However, a resin having a high solvent resistance against general organic solvents is preferably used because a photosensitive layer is coated on the intermediate layer.

Specific examples of such resins include water-soluble resins such as polyvinylalcohol, casein and sodium polyacrylate; alcohol-soluble resins such as nylon copolymers and methoxymethylated nylon; and curing resins forming a 3-dimensional network structure such as polyurethane resins, melamine resins and epoxy resins.

The intermediate layer preferably has a thickness of from 0.5 to 50 $\mu$m, and more preferably from 1.0 to 20 $\mu$m.

The volume ratio of the powder (P) and the binder resin (R), i.e., P/R of the intermediate layer is preferably from 1/1 to 3/1. When the P/R is less than 1/1, the properties of the intermediate layer tend to depend on the properties of the resin. When the P/R is greater than 3/1, the intermediate layer has many empty spaces therein and air bubbles tend to generate in the photosensitive layer formed thereon.

The relative mirror reflectance T2 of the present invention changes in accordance with the pigment. However, T2 can be also controlled by the dispersed condition of the pigment, and the affinity and mixing ratio of the pigment and the binder resin.

Charge Generation Layer

As a charge generation material which can be used for the photoreceptor of the present invention, a pigment which is sensitive to a long wavelength can be used. For example, phthalocyanine pigments such as metallic phthalocyanine and metal-free phthalocyanine, azulenium salt pigments, Squarilium salt pigments and azo pigments can be used. The relative mirror reflectance T1 can be preferably obtained by using a disazo pigment having the following formula (I). Particularly, a coupler residual group having the formula (II) can be preferably used in respect of sensitivity of the resultant photoreceptor.

The reason is still unapparent, however, a shape of the crystal particle and an agglomerating condition in forming a layer of the disazo pigment having the following formula (I) are considered to have some optical good effects. In addition, even if the disazo pigment is mixed with other heterogeneous pigments according to the wavelength to be absorbed, a sufficient effect can be expected.

(I)

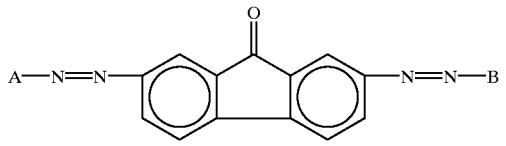

wherein A and B independently represent a coupler residual group having one of the following formulae (II) to (VIII).

(II)

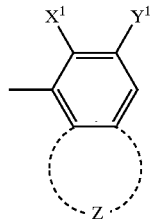

wherein $X^1$ represents —OH, —$NHCOCH_3$ or —$NHSO_2CH_3$; $Y^1$ represents —$CON(R^2)(R^3)$, —$CONHN{=}C(R^6)(R^7)$, —$CONHN(R^8)(R^9)$, —$CONHCONH(R^{12})$, a hydrogen atom, —COOH, —$COOCH_3$, $COOC_6H_5$ or a benzimidazolyl group, wherein $R^2$ and $R^3$ independently represent a hydrogen atom, a substituted or unsubstituted alkyl group, a substituted or unsubstituted aryl group and a substituted or unsubstituted hetero ring group; $R^2$ and $R^3$ optionally form a ring together with a nitrogen atom; $R^6$ and $R^7$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^6$ and $R^7$ optionally form a ring together with a carbon atom; $R^8$ and $R^9$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^8$ and $R^9$ optionally form a 5 or 6 membered ring, which optionally includes a condensed aromatic group; and $R^{12}$ represents a substituted or unsubstituted alkyl group, a substituted or unsubstituted aryl group and a substituted or unsubstituted hetero ring group; and Z represents a residual group selected from the group consisting of groups which are combined with the adjacent benzene ring to form a naphthalene ring, an anthracene ring, a carbazole ring, a benzocarbazole ring, a dibenzocarbazole ring, a dibenzofuran ring, a benzonaphthofuran ring and a dibenzothiophene ring; or a residual ring needed to form a hetero ring, which optionally have a substituted group;

(III)

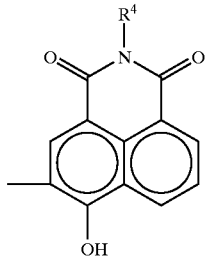

wherein $R^4$ represents a hydrogen atom, a substituted or unsubstituted alkyl group, or a substituted or unsubstituted aryl group;

(IV)

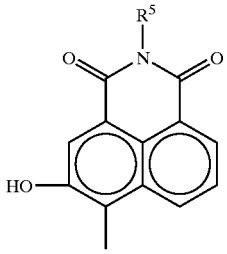

wherein $R^5$ represents a hydrogen atom, a substituted or unsubstituted alkyl group, or a substituted or unsubstituted aryl group;

(V)

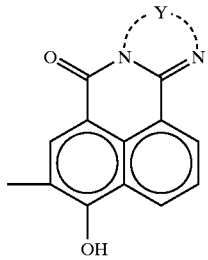

wherein Y represents a divalent aromatic hydrocarbon group or a divalent hetero ring including a nitrogen atom in the ring;

(VI)

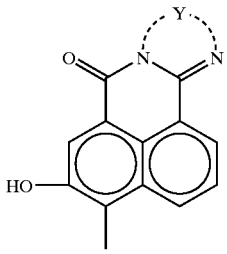

wherein Y represents a divalent aromatic hydrocarbon group or a divalent hetero ring including a nitrogen atom in the ring;

(VII)

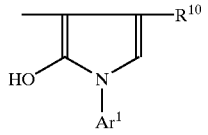

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group; and (VIII)

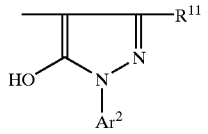

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group.

Within the context of the present invention, the term "alkyl group" means a saturated hydrocarbyl group having from 1 to 16 carbons, preferably from 1 to 11 carbons. Preferred alkyl groups include, but are not limited to methyl, ethyl, propyl, butyl, pentyl, hexyl, heptyl, octyl, nonyl, decyl, and undecyl groups, either linear or branched. More preferred are methyl, ethyl, propyl, butyl, hexyl and undecyl.

Within the context of the present invention, the term "aryl group" means mono to hexavalent aromatic hydrocarbon groups made of aromatic hydrocarbon rings, preferably including but not limited to, phenyl, naphthyl, anthracenyl and pyrenyl, which may be unsubstited or substituted.

Within the context of the present invention, the term "aralkyl group" means a combination of one of the above mentioned aryl groups and one of the above mentioned alkyl groups, wherein the group is preferably attached to the molecule core through the alkyl portion of the group.

Within the context of the present invention, the term "hetero ring group" means mono-to-hexavalent aromatic heterocyclic groups having one or more aromatic heterocyclic rings. The aromatic heterocyclic rings include, but are not limited to, pyridinyl, quinolinyl, thiophenyl, furyl, oxazolyl, oxadiazolyl and carbazolyl, wherein the heterocyclic ring may be substituted or unsubtituted.

When any of the above noted aromatic (either aryl or heteroaryl) groups is substituted, the substituents can be selected from any substituent that does not interfere with the charge generation properties of the compound. Preferably the substituent includes, but is not limited to, one or more groups independently selected from alkyl having 1 to 16 carbons, alkoxy groups having 1 to 16 carbons, halogen groups and aryl groups as defined above. More preferably, the substituent(s) include one or more groups independently selected from methyl, ethyl, propyl, butyl, hexyl, undecyl, methoxy, ethoxy, propoxy, butoxy, fluoro, chloro, bromo, iodo and the above noted aryl groups.

Specific examples of the couplers forming a coupler residual group of the disazo pigments having the formula (I) are shown in Tables 1 to 16.

TABLE 1-1

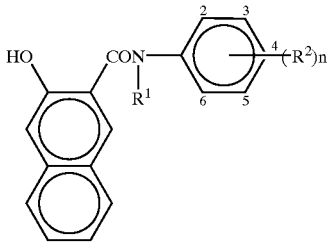

| Coupler No. | $R^1$ | $(R^2)n$ | Melting Point (° C.) |
|---|---|---|---|
| 1 | H | H | 243 to 244 |
| 2 | H | 2-$NO_2$ | 194 to 196 |
| 3 | H | 3-$NO_2$ | 246 to 247 |
| 4 | H | 4-$NO_2$ | 266 to 267.5 |
| 5 | H | 2-$CF_3$ | 178 to 179 |
| 6 | H | 3-$CF_3$ | 237.5 to 238.5 |
| 7 | H | 4-$CF_3$ | 279 to 281 |
| 8 | H | 2-CN | 221 to 222.5 |
| 9 | H | 3-CN | 256.5 to 258.5 |
| 10 | H | 4-CN | 274.5 to 277 |
| 11 | H | 2-I | 199 to 199.5 |
| 12 | H | 3-I | 258.5 to 259.5 |
| 13 | H | 4-I | 261.5 to 262 |
| 14 | H | 2-Br | 217 to 218 |
| 15 | H | 3-Br | 254 to 255 |
| 16 | H | 4-Br | 265 to 268 |
| 17 | H | 2-Cl | 228 to 230 |
| 18 | H | 3-Cl | 256.5 to 257 |

TABLE 1-2

| Coupler No. | $R^1$ | $(R^2)n$ | Melting Point (° C.) |
|---|---|---|---|
| 19 | H | 4-Cl | 264 to 266 |
| 20 | H | 2-F | 223.0 to 224.0 |
| 21 | H | 3-F | 250.0 to 251.0 |
| 22 | H | 4-F | 265.0 to 267.0 |
| 23 | H | 2-$CH_3$ | 195.5 to 198.0 |
| 24 | H | 3-$CH_3$ | 214.5 to 216.5 |
| 25 | H | 4-$CH_3$ | 227.0 to 229.0 |
| 26 | H | 2-$C_2H_5$ | 168.5 to 169.5 |
| 27 | H | 4-$C_2H_5$ | 203.0 to 204.5 |
| 28 | H | 2-$OCH_3$ | 167 to 168 |
| 29 | H | 3-$OCH_3$ | 195.5 to 198.0 |
| 30 | H | 4-$OCH_3$ | 229 to 230 |
| 31 | H | 2-$OC_2H_5$ | 157 to 158 |
| 32 | H | 3-$OC_2H_5$ | 188.5 to 189.0 |
| 33 | H | 4-$OC_2H_5$ | 225.0 to 225.5 |
| 34 | H | 4-$N(CH_3)_2$ | 232.0 to 233.5 |
| 35 | —$CH_3$ | H | 189.5 to 190.5 |
| 36 | 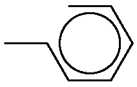 | H | 182.0 to 183.0 |
| 37 | H | 2-$OCH_3$, 5-$OCH_3$ | 186.0 to 188.0 |
| 38 | H | 2-$OC_2H_5$, 5-$OC_2H_5$ | 173.0 to 173.5 |
| 39 | H | 2-$CH_3$, 5-$CH_3$ | 207.0 to 208.5 |
| 40 | H | 2-Cl, 5-Cl | 253.5 to 254.5 |

TABLE 1-3

| Coupler No. | $R^1$ | $(R^2)n$ | Melting Point (° C.) |
|---|---|---|---|
| 41 | H | 2-$CH_3$, 5-Cl | 245 to 247 |
| 42 | H | 2-$OCH_3$, 4-$OCH_3$ | 151.0 to 152.0 |
| 43 | H | 2-$CH_3$, 4-$CH_3$ | 226 to 228 |
| 44 | H | 2-$CH_3$, 4-Cl | 244 to 245 |
| 45 | H | 2-$NO_2$, 4-$OCH_3$ | 179.5 to 181.0 |
| 46 | H | 3-$OCH_3$, 5-$OCH_3$ | 180.5 to 182.0 |
| 47 | H | 2-$OCH_3$, 5-Cl | 219.0 to 220.0 |
| 48 | H | 2-$OCH_3$, 5-$OCH_3$, 4-Cl | 193.5 to 195.5 |
| 49 | H | 2-$OCH_3$, 4-$OCH_3$, 5-Cl | 193 to 194 |
| 50 | H | 3-Cl, 4-Cl | 272.5 to 273.5 |
| 51 | H | 2-Cl, 4-Cl, 5-Cl | 257.5 to 258.5 |
| 52 | H | 2-$CH_3$, 3-Cl | 227.5 to 228.5 |
| 53 | H | 3-Cl, 4-$CH_3$ | 259.5 to 260.5 |
| 54 | H | 2-F, 4-F | 246.0 to 246.5 |
| 55 | H | 2-F, 5-F | 259.0 to 260.0 |
| 56 | H | 2-Cl, 4-$No_2$ | 283.0 to 284.0 |
| 57 | H | 2-$No_2$, 4-Cl | 226.5 to 227.5 |
| 58 | H | 2-Cl, 3-Cl, 4-Cl, 5-Cl | 280.0 to 281.5 |
| 59 | H | 4-OH | 268 |

TABLE 2-1

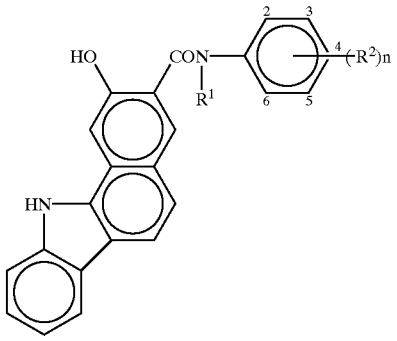

| Coupler No. | $R^1$ | $(R^2)n$ | Melting Point (° C.) |
|---|---|---|---|
| 60 | H | H | >300 |
| 61 | H | 2-$NO_2$ | 283 to 284 |
| 62 | H | 3-$NO_2$ | >300 |
| 63 | H | 4-$NO_2$ | >300 |
| 64 | H | 2-Cl | >300 |
| 65 | H | 3-Cl | >300 |
| 66 | H | 4-Cl | >300 |
| 67 | H | 2-$CH_3$ | >300 |
| 68 | H | 3-$CH_3$ | >300 |
| 69 | H | 4-$CH_3$ | >300 |
| 70 | H | 2-$C_2H_5$ | 271 to 273 |
| 71 | H | 4-$C_2H_5$ | >300 |
| 72 | H | 2-$OCH_3$ | 276 to 278 |
| 73 | H | 3-$OCH_3$ | >300 |
| 74 | H | 4-$OCH_3$ | >300 |
| 75 | H | 2-$OC_2H_5$ | 273.5 to 275.0 |
| 76 | H | 4-$OC_2H_5$ | >300 |
| 77 | H | 2-$CH_3$, 4-$OCH_3$ | 296 |

TABLE 2-2

| Coupler No. | $R^1$ | $(R^2)n$ | Melting Point (° C.) |
|---|---|---|---|
| 78 | H | 2-$CH_3$, 4-$CH_3$ | >300 |
| 79 | H | 2-$CH_3$, 5-$CH_3$ | |
| 80 | H | 2-$CH_3$, 6-$CH_3$ | |
| 81 | H | 2-$OCH_3$, 4-$OCH_3$ | |
| 82 | H | 2-$OCH_3$, 5-$OCH_3$ | |

TABLE 2-2-continued

| Coupler No. | $R^1$ | $(R^2)n$ | Melting Point (° C.) |
|---|---|---|---|
| 83 | H | 3-$OCH_3$, 5-$OCH_3$ | |
| 84 | H | 2-$CH_3$, 3-Cl | |
| 85 | H | 2-$CH_3$, 4-Cl | |
| 86 | H | 2-$CH_3$, 5-Cl | |
| 87 | H | 4-NH 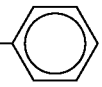 | |
| 88 | H | 2-$CH(CH_3)_2$ | |

TABLE 3-1

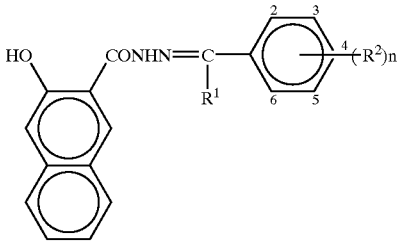

| Coupler No. | $R^1$ | $(R^2)n$ | Melting Point (° C.) |
|---|---|---|---|
| 89 | H | H | 228.0 to 230.0 |
| 90 | H | 4-$N(CH_3)_2$ | 238.5 to 240.0 |
| 91 | H | 2-$OCH_3$ | 218.0 to 222.0 |
| 92 | H | 3-$OCH_3$ | 186.5 to 188.5 |
| 93 | H | 4-$OCH_3$ | 224.5 to 225.0 |
| 94 | H | 4-$OC_2H_5$ | 236.0 to 237.5 |
| 95 | H | 2-$CH_3$ | 227.0 to 228.0 |
| 96 | H | 3-$CH_3$ | 212.5 to 214.0 |
| 97 | H | 4-$CH_3$ | 233.0 to 236.0 |
| 98 | H | 2-F | 233.0 to 233.5 |
| 99 | H | 3-F | 248.5 |
| 100 | H | 4-F | 239.5 to 240.0 |
| 101 | H | 2-Cl | 254.0 to 255.0 |
| 102 | H | 3-Cl | 226.5 to 230.0 |
| 103 | H | 4-Cl | 265.5 to 269.0 |
| 104 | H | 2-Br | 243.0 |
| 105 | H | 3-Br | 231.0 to 231.50 |
| 106 | H | 4-Br | 259.0 |

TABLE 3-2

| Coupler No. | $R^1$ | $(R^2)n$ | Melting Point (° C.) |
|---|---|---|---|
| 107 | H | 2-Cl, 4-Cl | 251.5 to 252.0 |
| 108 | H | 3-Cl, 4-Cl | 260.0 to 261.0 |
| 109 | H | 2-CN | 175.0 to 176.5 |
| 110 | H | 4-CN | 267.5 to 268.0 |
| 111 | H | 2-$NO_2$ | 240.0 |

TABLE 3-2-continued
| Coupler No. | $R^1$ | $(R^2)n$ | Melting Point (° C.) |
|---|---|---|---|
| 112 | H | 3-$NO_2$ | 255.5 to 257.0 |
| 113 | H | 4-$NO_2$ | 260.0 to 261.0 |
| 114 | H | 2-$CH_3$, 4-$CH_3$ | 234.5 to 236.5 |
| 115 | H | 2-$OCH_3$, 5-$OCH_3$ | 221.5 to 222.0 |
| 116 | H | 2-$OCH_3$, 3-$OCH_3$ 4-$OCH_3$ | 191.0 to 192.0 |
| 117 | —$CH_3$ | H | 248.5 to 250.0 |
| 118 | 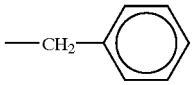 | H | 182.5 to 185.0 |
| 119 | 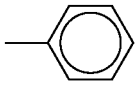 | H | 213.0 to 214.5 |
| 120 | H | 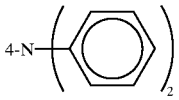 | 237.0 to 237.5 |
TABLE 4
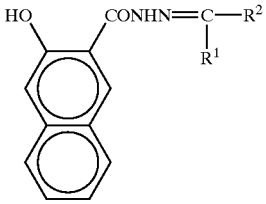
| Coupler No. | $R^1$ | $R^2$ | Melting Point (° C.) |
|---|---|---|---|
| 121 | —$CH_3$ | —$CH_3$ | 232.5 to 233.0 |
| 122 | H | 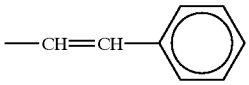 | 208.5 to 209.0 |
| 123 | H | 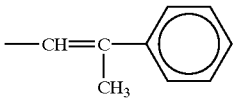 | 224.0 to 224.5 |
| 124 | H | 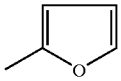 | 197.5 to 199.0 |
| 125 | H | 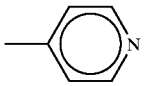 | 188.0 to 188.5 |
| 126 | H | 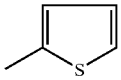 | 227.0 to 228.0 |
TABLE 4-continued
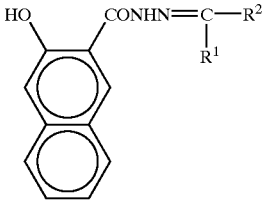
| Coupler No. | $R^1$ | $R^2$ | Melting Point (° C.) |
|---|---|---|---|
| 127 | —$CH_3$ | 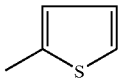 | 225.5 to 226.0 |
| 128 | H | 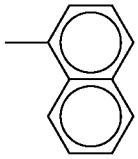 | 212.5 to 214.0 |
| 129 | H | 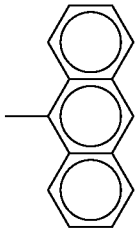 | 257 |
| 130 | H | 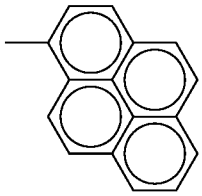 | 250 |
| 131 | H | 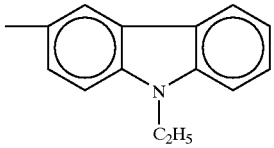 | 32.5 to 236.0 |
| 132 | H | 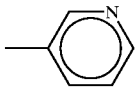 | 240.5 to 241.5 |

TABLE 5

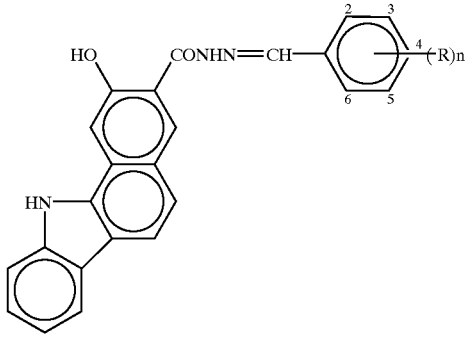

| Coupler No. | (R)n | Melting Point (° C.) |
|---|---|---|
| 133 | H | >300 |
| 134 | 2-$OCH_3$ | 268 |
| 135 | 3-$OCH_3$ | 281.0 to 283.0 |
| 136 | 4-$OCH_3$ | 293 |
| 137 | 2-$CH_3$ | 297 |
| 138 | 3-$CH_3$ | 296 |
| 139 | 4-$CH_3$ | >300 |
| 140 | 4-Cl | >300 |
| 141 | 2-$NO_2$ | >300 |
| 142 | 4-$NO_2$ | >300 |
| 143 | 2-OH | >300 |
| 144 | 2-OH, 3-$NO_2$ | >300 |
| 145 | 2-OH, 5-$NO_2$ | >300 |
| 146 | 2-OH, 3-$OCH_3$ | >300 |

TABLE 6

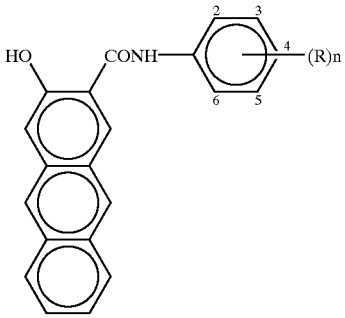

| Coupler No. | (R)n | Melting Point (° C.) |
|---|---|---|
| 147 | 4-Cl | >300 |
| 148 | 2-$NO_2$ | 268 |
| 149 | 3-$NO_2$ | >300 |
| 150 | 4-$NO_2$ | >300 |
| 151 | 4-NH— 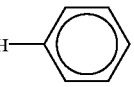 | 296 |
| 152 | H | 300 to 307 |
| 153 | 2-$OCH_3$ | 242 to 248 |
| 154 | 3-$OCH_3$ | 269 to 275 |
| 155 | 4-$OCH_3$ | 312 |
| 156 | 2-$CH_3$ | 265 to 270 |
| 157 | 3-$CH_3$ | 270 to 278 |
| 158 | 4-$CH_3$ | 304 |
| 159 | 2-Cl | 283 to 288 |
| 160 | 3-Cl | 281 to 287 |

TABLE 7

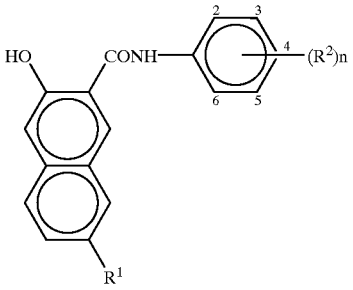

| Coupler No. | $R^1$ | ($R^2$)n | Melting Point (° C.) |
|---|---|---|---|
| 161 | H | 2-$OCH_3$, 4-Cl, 5-$CH_3$ | 208.0 to 208.5 |
| 162 | —$OCH_3$ | H | 230.5 to 231.5 |
| 163 | —$OCH_3$ | 2-$CH_3$ | 205.5 to 206.0 |
| 164 | —$OCH_3$ | 2-$OCH_3$, 5-$OCH_3$, 4-Cl | 245.5 to 246.0 |

TABLE 8

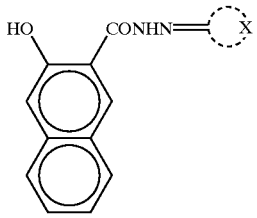

| Coupler No. | X | Melting Point (° C.) |
|---|---|---|
| 165 | 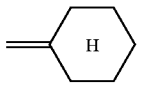 | 207.0 to 209.0 |
| 166 | 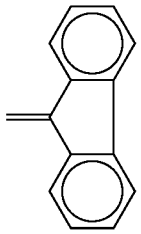 | 257.0 to 259.0 |
| 167 | 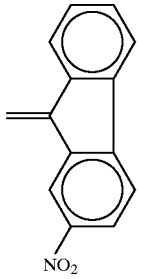 | 290 |

TABLE 9
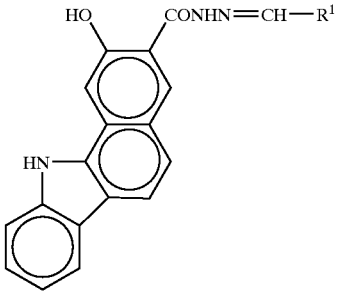
| Coupler No. | $R^1$ | Melting Point (° C.) |
|---|---|---|
| 168 | 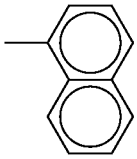 | >300 |
| 169 | 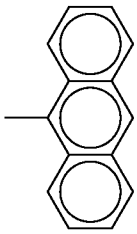 | >300 |
| 170 | 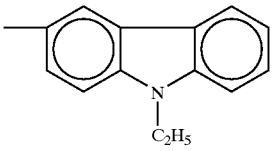  | >300 |
| 171 | 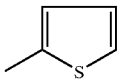  | 298 |
TABLE 10
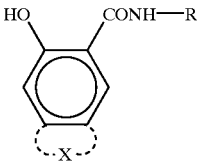
| Coupler No. | X | R | Melting Point (° C.) |
|---|---|---|---|
| 172 | 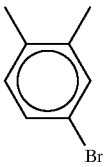  | 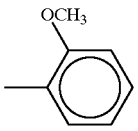  | 180 to 183 |
TABLE 10-continued
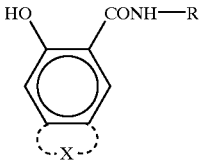
| Coupler No. | X | R | Melting Point (° C.) |
|---|---|---|---|
| 173 | 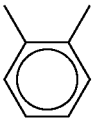 | 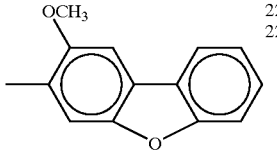  | 228.5 to 229.5 |
| 174 | 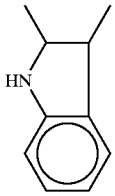  | 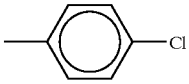  | >262 |
| 175 | 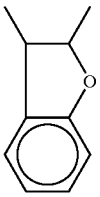  | 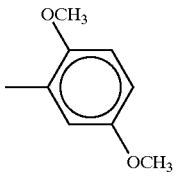  | 226.5 to 227.0 |
| 176 | 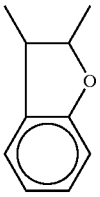  | 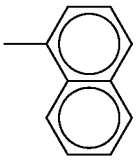 | 308 to 310 |
| 177 | 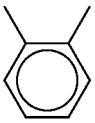 | 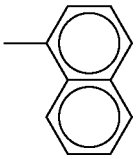 | 222 to 223 |

TABLE 11
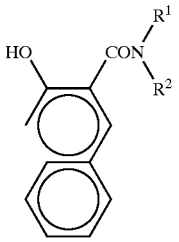
| Coupler No. | $R^1$ | $R^2$ | Melting Point (° C.) |
|---|---|---|---|
| 178 | H | H | 220.5 to 221.5 |
| 179 | —$CH_3$ | H | 190.5 to 192.5 |
| 180 | —$CH_3$ | —$CH_3$ | 196.0 to 198.0 |
| 181 | H | 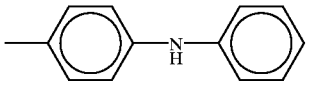 | 222.0 to 223.0 |
TABLE 12-1
| Coupler No. | Structure | Melting Point (° C.) |
|---|---|---|
| 182 | 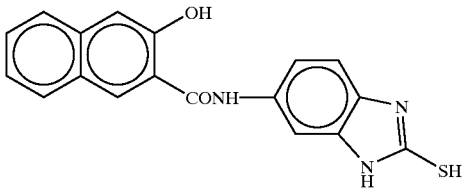 | >300 |
| 183 | 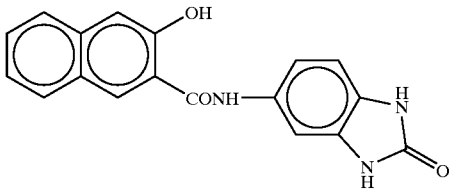 | >300 |
| 184 | 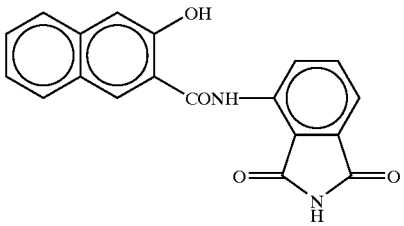 | >300 |

TABLE 12-1-continued
| Coupler No. | Structure | Melting Point (° C.) |
|---|---|---|
| 185 | 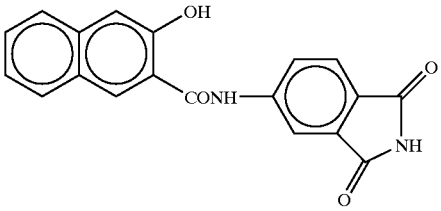 | >300 |
| 186 | 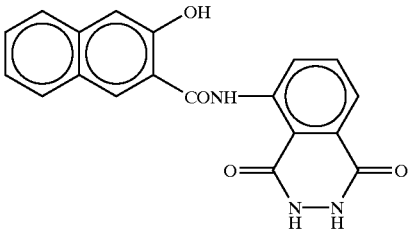 | >300 |
| 187 | 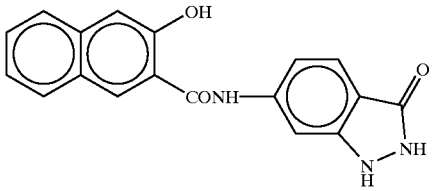 | >300 |
| 188 | 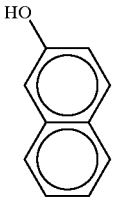 | 122.0 to 122.5 |
TABLE 12-2
| Coupler No. | Structure | Melting Point (° C.) |
|---|---|---|
| 189 | 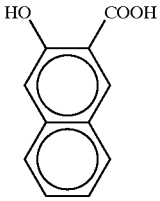 | 222.5 to 224.0 |
| 190 | 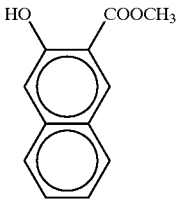 | 74.5 to 75.5 |
TABLE 12-2-continued
| Coupler No. | Structure | Melting Point (° C.) |
|---|---|---|
| 191 | 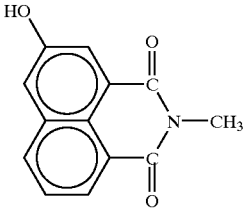 | 275.5 to 276.5 |
| 192 | 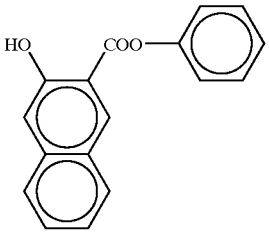 | 130.5 to 131.5 |

TABLE 12-2-continued
| Coupler No. | Structure | Melting Point (° C.) |
|---|---|---|
| 193 | 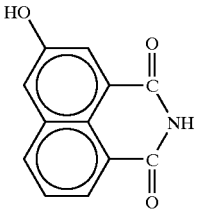 | >300 |
| 194 | 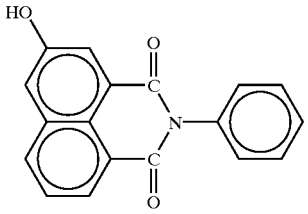 | >300 |
TABLE 12-2-continued
| Coupler No. | Structure | Melting Point (° C.) |
|---|---|---|
| 195 | 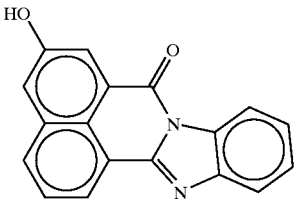 | >300 |
| 196 | 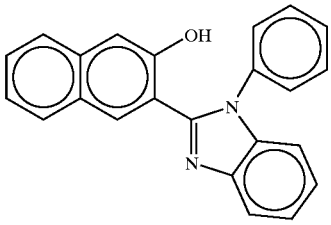 | 172.5 to 173.5 |
TABLE 12-3
| Coupler No. | Structure | Melting Point (° C.) |
|---|---|---|
| 197 | 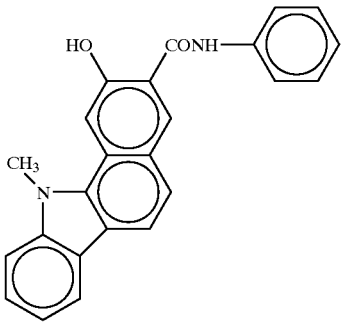 | 262.5 to 265.5 |
| 198 | 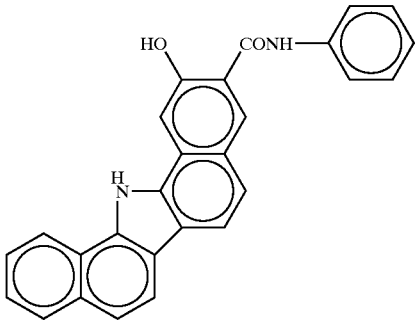 | >300 |

TABLE 12-3-continued

| Coupler No. | Structure | Melting Point (° C.) |
|---|---|---|
| 199 | 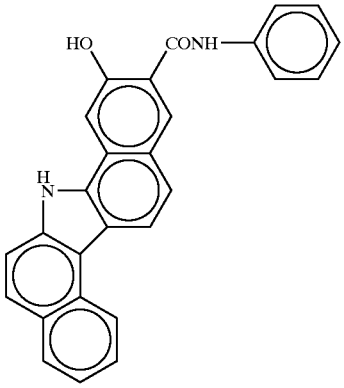 | >300 |
| 200 | 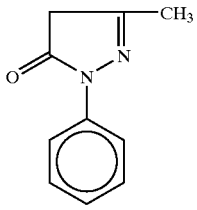 | 128.0 to 129.0 |

TABLE 13-1

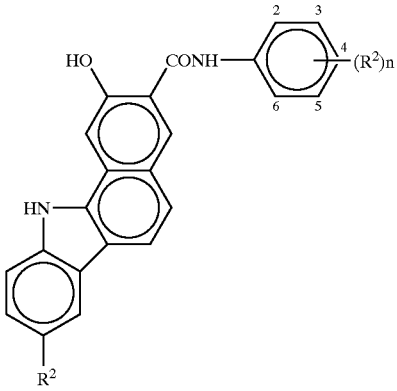

| Coupler No. | $R^1$ | $(R^2)n$ | Melting Point (° C.) |
|---|---|---|---|
| 201 | Cl | H | >300 |
| 202 | Cl | 2-$OCH_3$ | >300 |
| 203 | Cl | 3-$OCH_3$ | >300 |
| 204 | Cl | 4-$OCH_3$ | >300 |
| 205 | Cl | 2-$CH_3$ | >300 |
| 206 | Cl | 3-$CH_3$ | >300 |
| 207 | Cl | 4-$CH_3$ | >300 |
| 208 | Cl | 2-Cl | >300 |
| 209 | Cl | 3-Cl | >300 |
| 210 | Cl | 4-Cl | >300 |
| 211 | Cl | 2-$NO_2$ | >300 |
| 212 | Cl | 3-$NO_2$ | >300 |
| 213 | Cl | 4-$NO_2$ | >300 |
| 214 | Cl | 2-$CH_3$, 4-Cl | >300 |
| 215 | Cl | 2-$CH_3$, 4-$CH_3$ | >300 |
| 216 | Cl | 2-$C_2H_5$ | 299.0 to 301.0 |

TABLE 13-1-continued

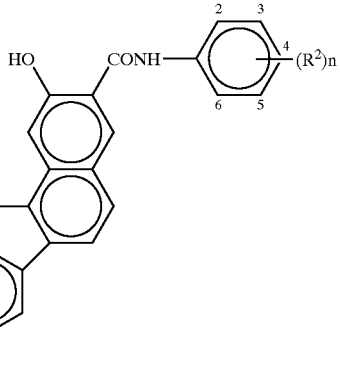

| Coupler No. | $R^1$ | $(R^2)n$ | Melting Point (° C.) |
|---|---|---|---|
| 217 | $CH_3$ | H | >300 |

TABLE 13-2

| Coupler No. | $R^1$ | $(R^2)n$ | Melting Point (° C.) |
|---|---|---|---|
| 218 | $CH_3$ | 2-$OCH_3$ | 297 |
| 219 | $CH_3$ | 3-$OCH_3$ | >300 |
| 220 | $CH_3$ | 4-$OCH_3$ | >300 |
| 221 | $CH_3$ | 2-$CH_3$ | >300 |
| 222 | $CH_3$ | 3-$OH_3$ | >300 |
| 223 | $CH_3$ | 4-$CH_3$ | >300 |
| 224 | $CH_3$ | 2-Cl | >300 |
| 225 | $CH_3$ | 3-Cl | >300 |
| 226 | $CH_3$ | 4-Cl | >300 |

TABLE 13-2-continued

| Coupler No. | $R^1$ | $(R^2)n$ | Melting Point (° C.) |
|---|---|---|---|
| 227 | $CH_3$ | 2-$NO_2$ | >300 |
| 228 | $CH_3$ | 3-$NO_2$ | >300 |
| 229 | $CH_3$ | 4-$NO_2$ | >300 |
| 230 | $CH_3$ | 2-$CH_3$, 4-Cl | >300 |
| 231 | $CH_3$ | 2-$CH_3$, 4-$CH_3$ | >300 |
| 232 | $CH_3$ | 2-$C_2H_5$ | 268.5 to 270.0 |
| 233 | $OCH_3$ | H | 289.0 |
| 234 | $OCH_3$ | 2-$OCH_3$ | 268.0 to 270.0 |
| 235 | $OCH_3$ | 3-$OCH_3$ | >300 |
| 236 | $OCH_3$ | 4-$OCH_3$ | >300 |
| 237 | $OCH_3$ | 2-$CH_3$ | 284.5 to 285.5 |
| 238 | $OCH_3$ | 3-$CH_3$ | >300 |
| 239 | $OCH_3$ | 4-$CH_3$ | >300 |

TABLE 13-3

| Coupler No. | $R^1$ | $(R^2)n$ | Melting Point (° C.) |
|---|---|---|---|
| 240 | $OCH_3$ | 2-Cl | >300 |
| 241 | $OCH_3$ | 3-Cl | >300 |
| 242 | $OCH_3$ | 4-Cl | >300 |
| 243 | $OCH_3$ | 2-$NO_2$ | >300 |
| 244 | $OCH_3$ | 3-$NO_2$ | >300 |
| 245 | $OCH_3$ | 4-$NO_2$ | >300 |
| 246 | $OCH_3$ | 2-$C_2H_5$ | 264.5 to 266.5 |

TABLE 14-1

| Coupler No. | Structure |
|---|---|
| 247 | 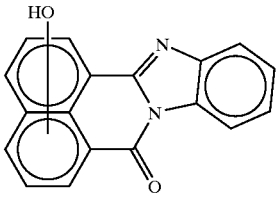 |
| 248 | 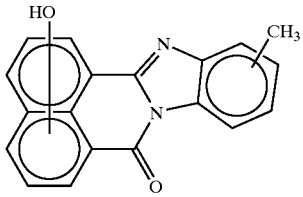 |
| 249 | 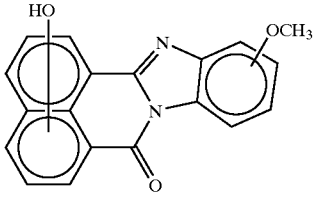 |

TABLE 14-1-continued

| Coupler No. | Structure |
|---|---|
| 250 | 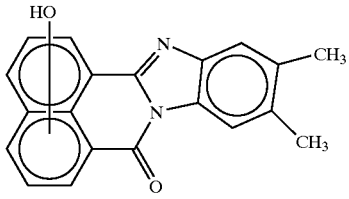 |
| 251 | 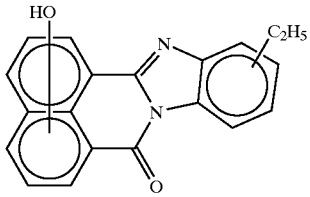 |
| 252 | 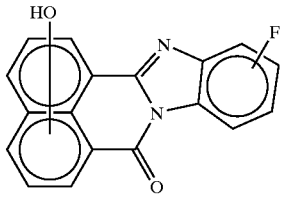 |
| 253 | 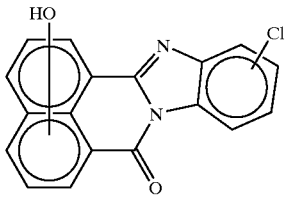 |

TABLE 14-2

| Coupler No. | Structure |
|---|---|
| 254 | 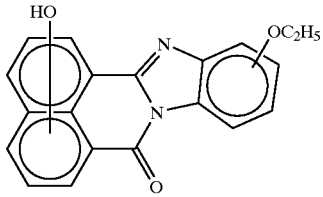 |
| 255 | 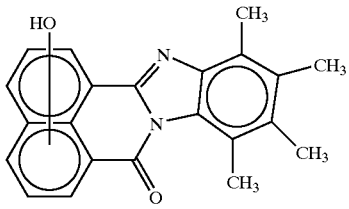 |

TABLE 14-2-continued

| Coupler No. | Structure |
|---|---|
| 256 | 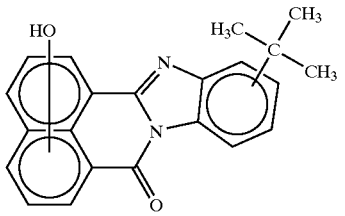 |
| 257 | 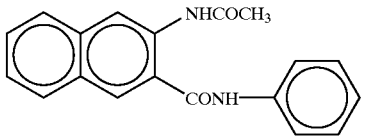 |
| 258 | 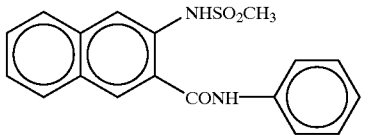 |

TABLE 15

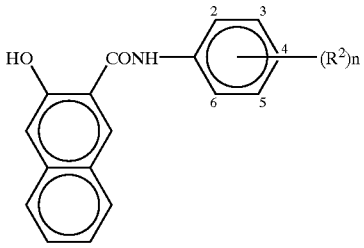

| Coupler No. | $(R^2)n$ |
|---|---|
| 259 | 2-Cl, 3-Cl |
| 260 | 2-Cl, 4-Cl |
| 261 | 3-Cl, 5-Cl |

TABLE 16

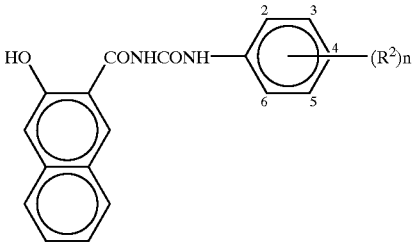

| Coupler No. | $(R^2)n$ |
|---|---|
| 262 | 4-$CH_3$ |
| 263 | 3-$NO_2$ |
| 264 | 2-Cl |
| 265 | 3-Cl |
| 266 | 4-Cl |
| 267 | 2-Cl, 3-Cl |
| 268 | 2-Cl, 4-Cl |
| 269 | 3-Cl, 5-Cl |

TABLE 16-continued

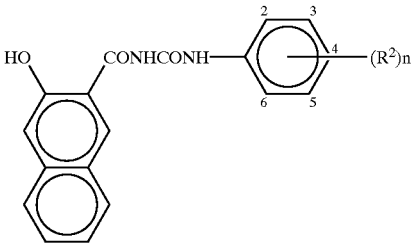

| Coupler No. | $(R^2)n$ |
|---|---|
| 270 | 2-Cl, 5-Cl |
| 271 | 3-Cl, 4-Cl |

The charge generation layer can be formed by the following method:

(1) the above-mentioned charge generation materials are dispersed in a liquid solution of a binder resin such as polyester resins, polycarbonate resins, polyvinylbutyral resins and acrylic resins by a ball mill, an attritor, a sand mill, etc; and (2) the dispersed liquid is properly diluted and coated on a substrate by a dip coating, a spray coating, a bead coating method, etc.

The relative mirror reflectance T1 of the present invention changes in accordance with the charge generation material. However, T1 can be also controlled by the dispersed condition of the charge generation material, and the affinity and mixing ratio of the pigment and the binder resin as well as the composition of the above-mentioned intermediate layer.

The charge generation layer preferably has a thickness of from 0.01 to 5 $\mu$m, and more preferably from 0.1 to 2 $\mu$m.

Charge Transport Layer

The charge transport layer is formed from a charge transport material and a binder resin which is optionally used.

The material is dissolved or dispersed in a proper solvent, and the liquid solution is coated on a substrate and dried to form the charge transport layer.

As the charge transport materials, there are a hole transport material and an electron transport material.

Specific examples of the hole transport materials include electron imparting materials such as poly-N-vinylcarbazole and its derivatives, poly-γ-carbazolylethylgultamate and its derivatives, pyrene-formaldehyde condensates and their derivatives, polyvinylpyrene, polyvinylphenanthrene, oxazole derivatives, oxadiazole derivatives, imidazole derivatives, triphenylamine derivatives, 9-(P-diethylaminostyryl)anthracene, 1,1-bis-(4-dibenzylaminophenyl)propane, styrylanthracene, styrylpyrazoline, phenylhydrazone compounds and α-phenylstilbene derivatives.

Specific examples of the electron transport materials include electron accepting materials such as chloranil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno [1,2-b] thiophene-4-one and 1,3,7-trinitrodibenzothiophene-5,5-dioxide. These charge transport materials can be used alone or in combination.

Specific examples of the binder resins for optional use in the present invention include thermoplastic or thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenol resins and alkyd resins.

Specific examples of the solvents include tetrahydrofuran, dioxane, toluene, monochlorobenzene, dichloroethane, methylene chloride, etc.

The charge transport layer preferably has a thickness of from 5 to 100 $\mu$/m.

In addition, a plasticizer and a leveling agent can be included in the charge transport layer of the present invention. As the plasticizer, conventional plasticizers for resins, such as dibutylphthalate and dioctylphthalate can be used. The content of the plasticizer is preferably from 0 to 30% by weight per 100% by weight of the binder resin. As the leveling agent, silicone oils such as dimethyl silicone oils and methyl phenyl silicone oils can be used. The content of the leveling agent is preferably from 0 to 1% by weight per 100% by weight of the binder resin.

In addition, an insulating layer and a protective layer can be formed on the photosensitive layer in the present invention.

Electroconductive Substrate

The substrate used for the photoreceptor of the present invention is formed as follows. Metals such as aluminium and nickel are deposited or laminated on metallic drums and sheets such as aluminium, brass, stainless and nickel; polyethyleneterephthalate; polypropylene; nylon; paper, etc. Among the substrates, a cylindrical drum formed of aluminium or its alloyed metals is widely used at present. Particularly, non-cut aluminium tube without a cutting process is preferably used because the manufacturing cost is lower and the adherence to the photosensitive layer is higher than that of a conventional cut aluminium tube.

In addition, the photoreceptor having the relative mirror reflectance of the present invention can prevent image-density irregularity of the resultant image even if the non-cut aluminium tube is used for the substrate.

Such aluminium alloys are formed by the method disclosed in JIS3003, 5000, 6000, etc. and the non-cut aluminium tube is formed by a conventional method such as EI, ED, DI and II methods.

In addition, neither a surface cut process and grind with a diamond turning tool, etc. nor a surface treatment such as anodizing is performed on the aluminium tube.

Electrophotographic Device and Method

Next, the electrophotographic process and device of the present invention will be explained in detail, referring to the drawings.

Figure 4:
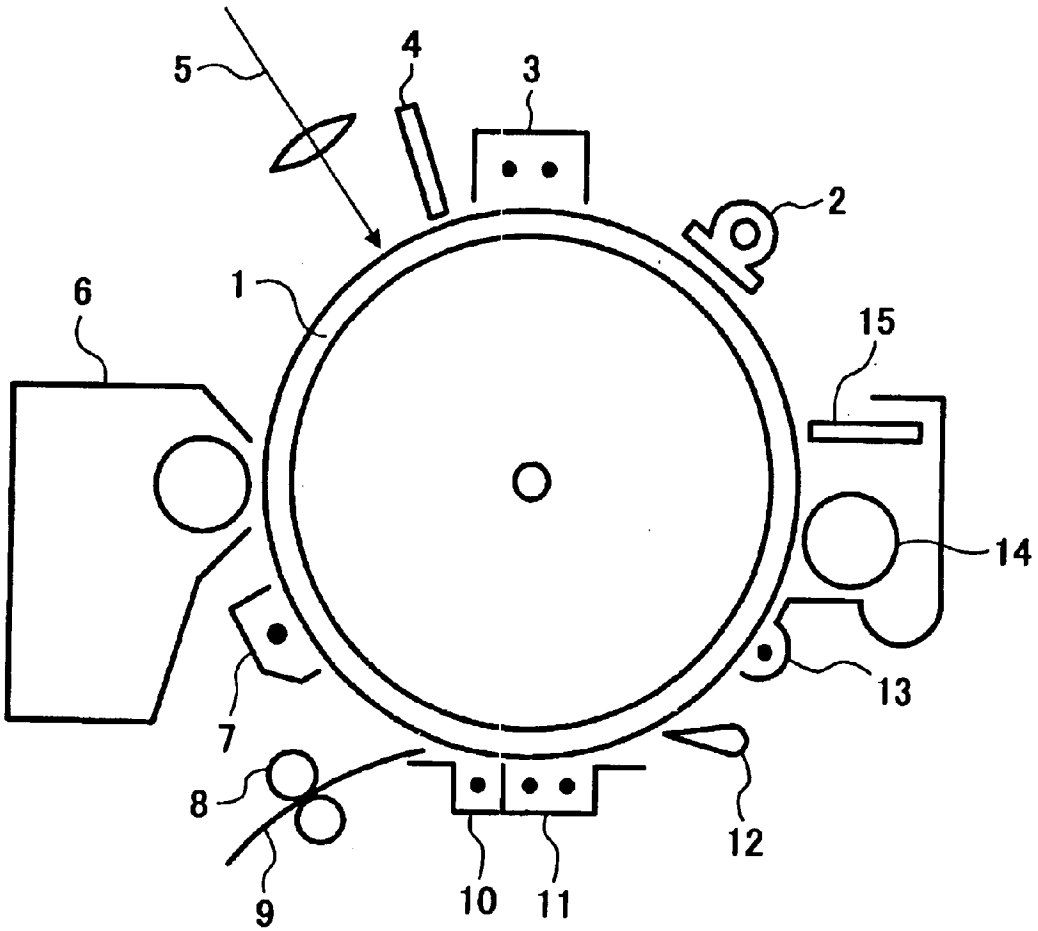
FIG. 4 is a schematic view of an embodiment of the electrophotographic process of the present invention.

FIG. 4 is a schematic view for explaining the electrophotographic process and device of the present invention, and the following modified example also belongs to the present invention. In FIG. 4, a photoreceptor 1 includes a drum substrate on which a photosensitive layer is formed. For a charger 3, a pre-transfer charger 7, a transfer charger 10, a separation charger 11 and a pre-cleaning charger 13, known chargers such as corotrons, scorotrons, solid state chargers and charging rollers are used. For the transfer means, the above-mentioned chargers can be used, however, a combination of a transfer charger 10 and a separation charger 11 as shown in FIG. 4 is effectively used. For an image irradiator 5, coherent light such as light emitting diodes (LEDS), laser diode (LDs) and electroluminescence (EL) lamps is used. As a light source for a discharging lamp 2, etc., any known illuminators such as fluorescent lamps, tungsten lamps, halogen lamps, mercury lamps, sodium lamps, light emitting diodes (LEDs), laser diodes (LDs) and electro luminescense (EL) lamps can be used. In order to irradiate only the light having a desired wavelength, various filters such as sharp cut filters, band pass filters, near infrared cutting filters, dichroic filters, interference filters and conversion filters can be also used. Such light sources can be also used for irradiating the photoreceptor in processes such as a transfer process combined with light irradiation, a charge eliminating process, a cleaning process, a pre-exposure process, etc. as well as the processes mentioned above.

Toner images formed on the photoreceptor 1 by developing unit 6 are transferred on a transfer paper 9. However, all of the toner particles of the toner images are not transferred on the transfer paper 9 and there also remain toner particles on the photoreceptor 1. Such toner particles are removed from photoreceptors by a fur brush 14 and a blade 15. Cleaning may be made only by a known cleaning brush such as fur brushes and mag-fur brushes.

When a photoreceptor is charge positively (negatively) and image exposure is performed, positive (negative) electrostatic latent images are formed on the surface of the photoreceptor. Positive images are obtained when the latent images are developed with negatively-charged (positively-charged) toners and negative images are obtained when the latent images are developed with positively-charged (negatively-charged) toners. As the developing method, known developing methods can be applied. In addition, known discharging methods can be used for discharging the charges remaining on the photoreceptor.

Figure 5:
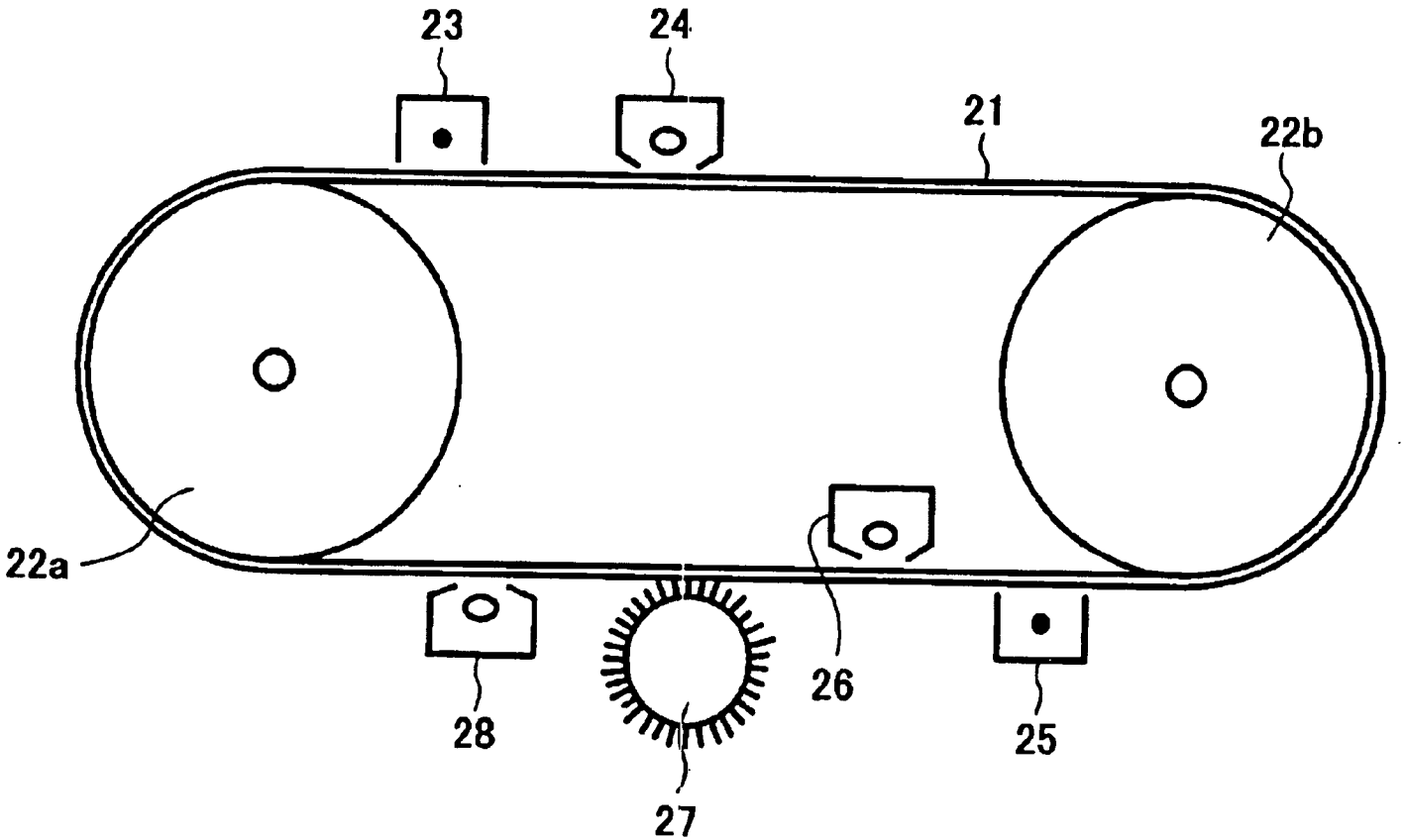
FIG. 5 is a schematic view of another embodiment of the electrophotographic process of the present invention.

FIG. 5 shows another embodiment of the electrophotographic process of the present invention. A photoreceptor 21 has the photosensitive layer of the present invention, and is driven by driving rollers 22*a* and 22*b*. The photoreceptor 21 is charged by a charger 23, and exposed to light emitted by a light source 24 to form a latent image thereon. Then the latent image is developed by an image developer (not illustrated) to form a toner image thereon. The toner image is transferred on a transfer paper (not shown) using a charger 25. The photoreceptor 21 is then subjected to a cleaning pre-exposure treatment using a light source 26, a cleaning treatment using a brush 27 and a discharging treatment using a light source 28. These processes are repeatedly performed to produce images. In FIG. 5, pre-cleaning light irradiates the photoreceptor 21 from the substrate side. (In this case, the substrate is transparent.)

For instance, in FIG. 5, although the cleaning pre-exposure is made from the substrate side, the cleaning pre-exposure may be made from the photosensitive layer side. In addition, irradiation of image exposure and discharging can be made from the substrate side. With respect to the light irradiation processes, the image exposure, cleaning pre-exposure and discharging exposure are illustrated. However, light irradiation such as pre-transfer exposure, pre-exposure of image exposure and other known light irradiation processes can be made to the photoreceptors.

Figure 6:
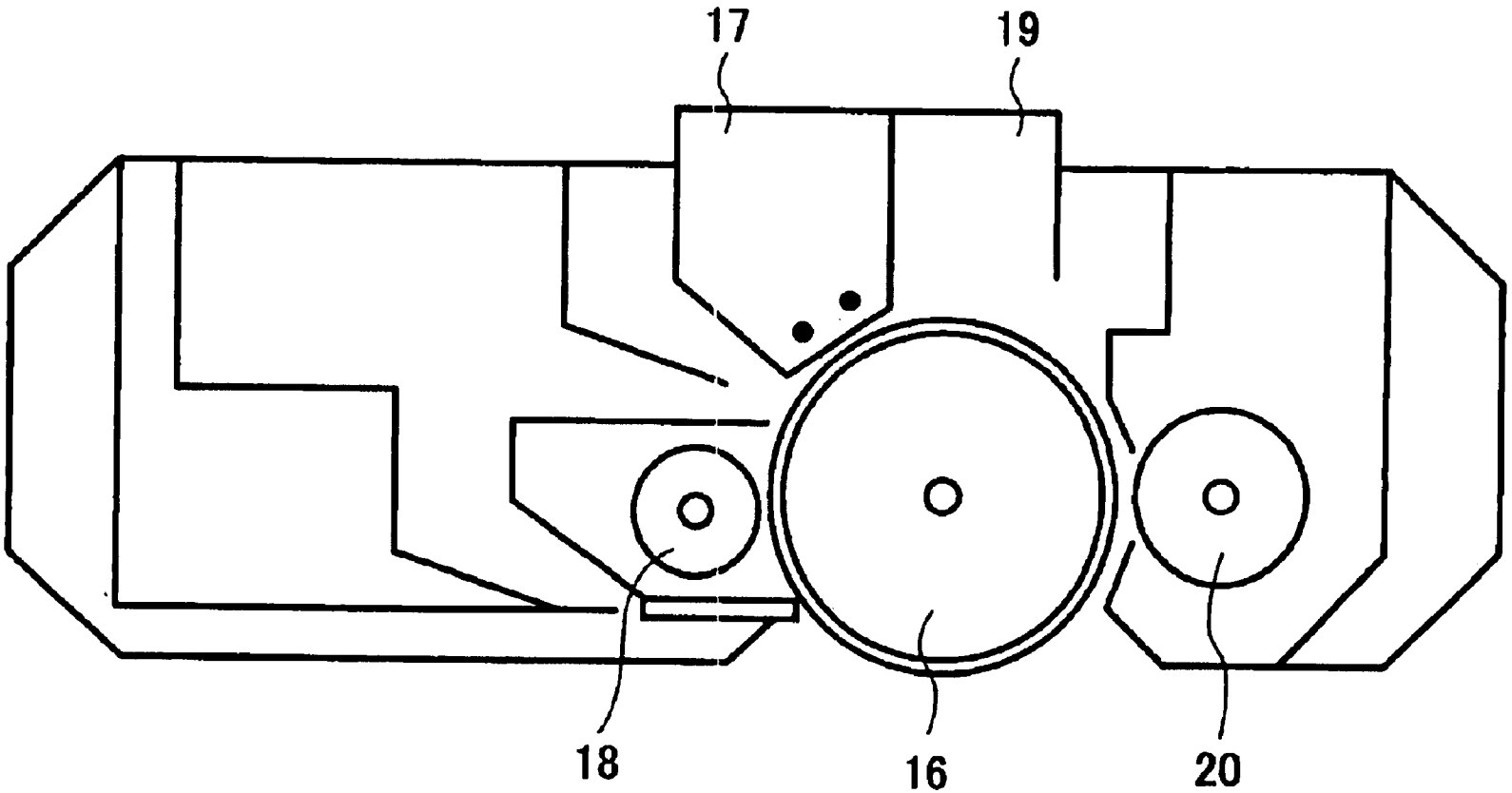
FIG. 6 is a schematic view of an embodiment of the process cartridge of the present invention.

The electrophotographic device as mentioned above can be fixedly installed into copiers, facsimiles and printers. In addition, they can be installed into these devices in the form of a process cartridge as well. The process cartridge is a device (part) containing at least a photoreceptor, and at least one of a charger, an image irradiator, an image developer, an image transfer, a cleaner and a discharger. There are many types of process cartridges, however, FIG. 6 is a schematic view illustrating an embodiment of the process cartridge of the present invention. A photoreceptor 16 has a photosensitive layer of the present invention.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

After 100 parts of a polyamide resin (FR101 from Namariichi Co., Ltd.) and 100 parts of a melamine resin (Super Bekkamin G-821-50 from Dainippon Ink & Chemicals, Inc.) were dissolved in 850 parts of methanol, 600 parts of a fine powder of titanium oxide (TP-2 from Fuji Titanium Industry Co., Ltd.) were added into the solution and the solution was stirred for 120 hrs by a ball mill. Then, 350 parts of methanol was further added into the solution to dilute the solution and prepare a coating liquid for an intermediate layer. The liquid was coated on an aluminium-deposited polyester film (Lumirror from Toray Industries, Inc.), and dried for 20 min at 150° C. to form an intermediate layer having a thickness of 5 $\mu$m. The relative mirror reflectance of the thus formed intermediate layer against an aluminium-deposited mirror at an incident angle of 5° was measured by a self-recording spectrophotometer (UV-3100 from Shimadzu Corp.). The results were as follows:

3.5% at a wavelength of 780 nm; and 3.1% at a wavelength of 650 nm.

Example 2

After 100 parts of a polyamide resin (FR101 from Namariichi Co., Ltd.) and 100 parts of a melamine resin (Super Bekkamin G-821-50 from Dainippon Ink & Chemicals, Inc.) were dissolved in 1000 parts of methanol, 900 parts of a fine powder of titanium oxide (TP-2 from Fuji Titanium Industry Co., Ltd.) were added into the solution and the solution was stirred for 72 hrs by a ball mill. Then, 700 parts of methanol was further added into the solution to dilute the solution and prepare a coating liquid for an intermediate layer. The liquid was coated on an aluminium-deposited polyester film (Lumirror from Toray Industries, Inc.), and dried for 20 min at 150° C. to form an intermediate layer having a thickness of 5 am. The relative mirror reflectance of the thus formed intermediate layer against an aluminium-deposited mirror at an incident angle of 5° was measured by a self-recording spectrophotometer (UV-3100 from Shimadzu Corp.). The results were as follows:

4.1% at a wavelength of 780 nm; and 3.7% at a wavelength of 650 nm.

Examples 3 and 4

On the intermediate layers formed in Examples 1 and 2, a coating liquid for a charge generation layer having the following components which were mixed and stirred by a ball mill for 120 hrs, was coated and dried to form a charge generation layer having a thickness of 0.5 $\mu$m.

A disazo pigment 5 having the following formula (A)

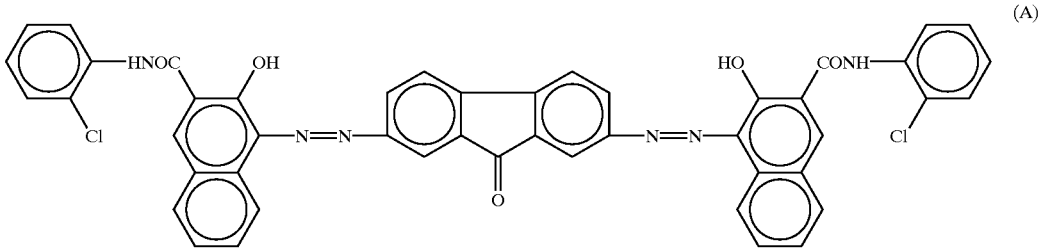

(A)

| | |
|---|---|
| A polyvinylbutyral resin (S-LEC BM-S from Sekisui Chemical Co., Ltd.) | 1 |
| Cyclohexanone | 250 |

The relative mirror reflectance of the thus formed intermediate layers and charge generation layers against an aluminium-deposited mirror at an incident angle of 5° was measured by a self-recording spectrophotometer (UV-3100 from Shimadzu Corp.). The results were as follows:

2.8% and 3.1% respectively at a wavelength of 780 nm; and 2.6% and 2.9% respectively at a wavelength of 650 nm.

Examples 5 and 6

On the intermediate layers formed in Examples 1 and 2, a coating liquid for a charge generation layer having the following components which were mixed and stirred by a ball mill for 120 hrs, was coated and dried to form a charge generation layer having a thickness of 0.5 $\mu$m.

A disazo pigment 1.5 having the following formula (A)

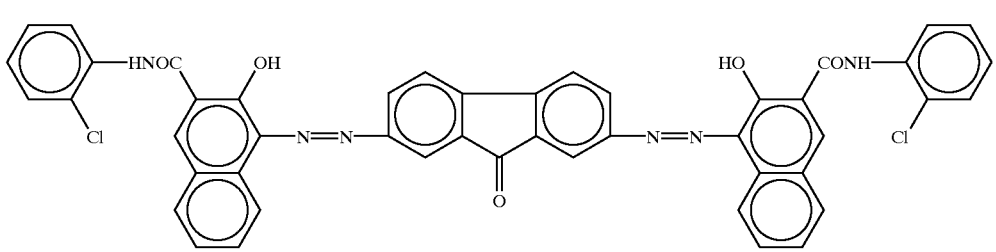

| | |
|---|---|
| A polyvinylbutyral resin (XYHL from Union Carbide Corp.) | 1 |
| Cyclohexanone | 250 |

The relative mirror reflectance of the thus formed intermediate layers and charge generation layers against an aluminium-deposited mirror at an incident angle of 50 was measured by a self-recording spectrophotometer (UV-3100 from Shimadzu Corp.). The results were as follows:

2.6% and 2.9% respectively at a wavelength of 780 nm; and 2.4% and 2.7% respectively at a wavelength of 650 nm.

Comparative Examples 1 and 2

On the intermediate layers formed in Examples 1 and 2, a coating liquid for a charge generation layer having the following components which were mixed and stirred by a ball mill for 24 hrs, was coated and dried to form a charge generation layer having a thickness of 0.3 μm.

| | |
|---|---|
| A-type titanylphthalocyanine | 5 |
| A polyvinylbutyral resin (S-LEC BM-S from Sekisui Chemical Co., LTD.) | 5 |
| Methyl ethyl ketone | 350 |

The relative mirror reflectance of the thus formed intermediate layers and charge generation layers against an aluminium-deposited mirror at an incident angle of 5° was measured by a self-recording spectrophotometer (UV-3100 from Shimadzu Corp.). The results were as follows:

4.0% and 4.5% respectively at a wavelength of 780 nm; and 3.6% and 4.1% respectively at a wavelength of 650 nm.

Examples 7 and 8

On the intermediate layers formed in Examples 1 and 2, a coating liquid for a charge generation layer having the following components which were mixed and stirred by a ball mill for 120 hrs, was coated and dried to form a charge generation layer having a thickness of 0.4 μm.

| | |
|---|---|
| A-type titanylphthalocyanine | 5 |
| A disazo pigment | 5 |

having the following formula (B)

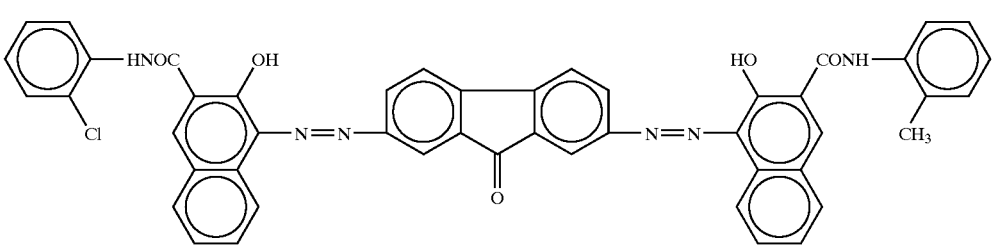

| | |
|---|---|
| A polyvinylbutyral resin (S-LEC BM-S from Sekisui Chemical Co., LTD.) | 5 |
| Cyclohexanone | 250 |

The relative mirror reflectance of the thus formed intermediate layers and charge generation layers against an aluminium-deposited mirror at an incident angle of 5° was measured by a self-recording spectrophotometer (UV-3100 from Shimadzu Corp.). The results were as follows:

2.9% and 3.3 respectively at a wavelength of 780 nm; and 2.7% and 3.1% respectively at a wavelength of 650 nm.

Examples 9 to 14 and Comparative Examples 3 to 4

The procedures of Examples 3 to 8 and Comparative Examples 1 to 2 were repeated except that each coating liquid was coated on a non-cut aluminium tube formed by an ED method, having an outer diameter of 30 mm and a length of 340 mm. A coating liquid for a charge transport layer having the following components was further coated on each coated tube, and dried to form a charge transport layer having a thickness of 20 μm.

| | |
|---|---|
| 4-diethylaminobenzaldehyde-1-benzyl-1-phenylhydrazne | 7 |
| Polycarbonate (Iupilon from Mitsubishi Gas Chemical Co., Inc.) | 10 |
| Tetrahydrofuran | 76 |

Thus, photoreceptors of Examples 9 to 14 and Comparative Examples 3 to 4 were prepared.

Examples 15 to 20 and Comparative Examples 5 to 6

The procedures for preparation of photoreceptors of Examples 9 to 14 and Comparative Examples 3 to 4 were repeated except for using a cut aluminium having an outer diameter of 30 mm and a length of 340 mm.

After the thus prepared photoreceptors of Examples 9 to 20 and Comparative Examples 3 to 6 were installed in the electrophotographic process cartridge shown in FIG. 6, each process cartridge was installed in the following electrophotographic processes A to E shown in FIG. 4.

| | Wavelength of light source for image irradiator (LD) | Diameter of image writing light beam by a polygon mirror | Light spot interval/ overlapped area |
|---|---|---|---|
| A | 780 nm | 75 × 85 μm | 64 μm/44% |
| B | 780 nm | 50 × 60 μm | 42 μm/50% |
| C | 780 nm | 55 × 70 μm | 55 μm/70% |
| D | 650 nm | 30 × 40 μm | 21 μm/95% |
| E | 650 nm | 16 × 20 μm | 11 μm/98% |

A halftone image was produced from each electrophotographic process and the image-density irregularity due to light interference was evaluated. The results are shown in Table 17.

TABLE 17

| | RMR-IL | RMR-CG | Substrate | IDI A | IDI B | IDI C | IDI D | IDI E |
|---|---|---|---|---|---|---|---|---|
| Ex. 9 | 3.5/3.1 | 2.8/2.6 | Non-cut | ○ | ○ | ○ | ○ | ○ |
| Ex. 10 | 4.1/3.7 | 3.1/2.9 | Non-cut | ○ | ○ | ○ | ○ | Δ |
| Ex. 11 | 3.5/3.1 | 2.6/2.4 | Non-cut | ○ | ○ | ○ | ○ | ○ |
| Ex. 12 | 4.1/3.7 | 2.9/2.7 | Non-cut | ○ | ○ | ○ | ○ | Δ |
| Com. Ex. 3 | 3.5/3.1 | 4.0/3.6 | Non-cut | Δ | Δ | X | Δ | X |
| Com. Ex. 4 | 4.1/3.7 | 4.5/4.1 | Non-cut | X | X | X | X | X |
| Ex. 13 | 3.5/3.1 | 2.9/2.7 | Non-cut | ○ | ○ | ○ | ○ | ○ |
| Ex. 14 | 4.1/3.7 | 3.3/3.1 | Non-cut | ○ | Δ | Δ | Δ | X |
| Ex. 15 | 3.5/3.1 | 2.8/2.6 | Cut | ○ | ○ | ○ | ○ | ○ |
| Ex. 16 | 4.1/3.7 | 3.1/2.9 | Cut | ○ | ○ | ○ | ○ | ○ |
| Ex. 17 | 3.5/3.1 | 2.6/2.4 | Cut | ○ | ○ | ○ | ○ | ○ |
| Ex. 18 | 4.1/3.7 | 2.9/2.7 | Cut | ○ | ○ | ○ | ○ | ○ |
| Com. Ex. 5 | 3.5/3.1 | 4.0/3.6 | Cut | Δ | Δ | Δ | Δ | X |
| Com. Ex. 6 | 4.1/3.7 | 4.5/4.1 | Cut | X | X | X | X | X |
| Ex. 19 | 3.5/3.1 | 2.9/2.7 | Cut | ○ | ○ | ○ | ○ | ○ |
| Ex. 20 | 4.1/3.7 | 3.3/3.1 | Cut | ○ | ○ | ○ | ○ | Δ |

RMR-IL: Relative mirror reflectance of intermediate layer
RMR-CGL: Relative mirror reflectance of charge generation layer
IDI: Image-density irregularity
○: Image-density irregularity did not occur
Δ: Image-density irregularity slightly occurred
X: Image-density irregularity occurred On the other hand, durability test for Example 9 and Comparative Example 15 was performed by producing continuous 50,000 images. It was observed that the end of the photosensitive layer of the photoreceptor of Example 15 was partly peeled off, and that the non-cut aluminium tube used in Example 9 had higher adherence to the photosensitive layer than that of Example 15.

This document claims priority and contains subject matter related to Japanese Patent Application No. 2001-086067 filed on Mar. 23, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image irradiator configured to irradiate a photoreceptor with a coherent light beam while scanning to form pixel light spots thereon for forming an electrostatic latent image thereon, wherein the light spots overlap with adjacent light spots; and an image developer configured to develop the electrostatic latent image with a developer, wherein the photoreceptor comprises an intermediate layer located overlying an electroconductive substrate, a charge generation layer located overlying the intermediate layer and a charge transport layer located overlying the charge generation layer, wherein the charge generation layer satisfies the following relationship:

$$T1 \leqq 3.5\%$$

wherein T1 represents a relative mirror reflectance of the charge generation layer against the coherent light beam when the coherent light beam irradiates the charge generation layer at an incident angle of 5°.

2. The image forming apparatus of claim 1, wherein the intermediate layer and the charge generation layer satisfy the following relationship:

$$T1 \leqq T2 \leqq 3.5\%$$

wherein T2 represents a relative mirror reflectance of the intermediate layer against the coherent light when the coherent light irradiates the intermediate layer at an incident angle of 5°.

3. The image forming apparatus of claim 1, wherein each of the pixel light spots has a diameter not greater than 40 μm and the overlapped area is not less than 50% of the area of each of the light spots.

4. The image forming apparatus of claim 1, wherein the electroconductive substrate comprises a non-cut aluminum substrate.

5. The image forming apparatus of claim 4, wherein said non-cut aluminum substrate is formed by a drawing method.

6. The image forming apparatus of claim 1, wherein the charge generation layer comprises a disazo pigment having the following formula (I):

(I)

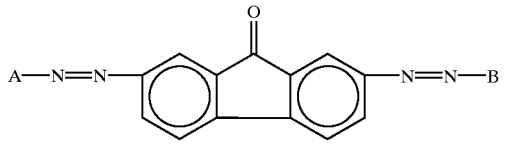

wherein A and B independently represent a coupler residual group having one of the following formulae (II) to (VIII)

(II)

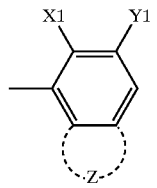

wherein $X^1$ represents —OH, —$NHCOCH_3$ or —$NHSO_2CH_3$; $Y^1$ represents —$CON(R^2)(R^3)$, —$CONHN{=}C(R^6)(R^7)$, —$CONHN(R^8)(R^9)$, —$CONHCONH(R^{12})$, a hydrogen atom, —COOH, —$COOCH_3$, $COOC_6H_5$ or a benzimidazolyl group, wherein $R^2$ and $R^3$ independently represent a hydrogen atom, a substituted or unsubstituted alkyl group, a substituted or unsubstituted aryl group and a substituted or unsubstituted hetero ring group; $R^2$ and $R^3$ optionally form a ring together with a nitrogen atom; $R^6$ and $R^7$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^6$ and $R^7$ optionally form a ring together with a carbon atom; $R^8$ and $R^9$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^8$ and $R^9$ optionally form a 5 or 6 membered ring, which optionally includes a condensed aromatic group; and $R^{12}$ represents a substituted or unsubstituted alkyl group, a substituted or unsubstituted aryl group and a substituted or unsubstituted hetero ring group; and Z represents a residual group selected from the group consisting of groups which are combined with the adjacent benzene ring to form a naphthalene ring, an anthracene ring, a carbazole ring, a benzocarbazole ring, a dibenzocarbazole ring, a dibenzofuran ring, a benzonaphthofuran ring and a dibenzothiophene ring; or a residual ring needed to form a hetero ring, which optionally have a substituted group;

(III)

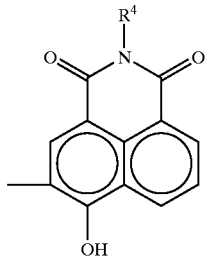

wherein $R^4$ represents a hydrogen atom, a substituted or unsubstituted alkyl group, or a substituted or unsubstituted aryl group;

(IV)

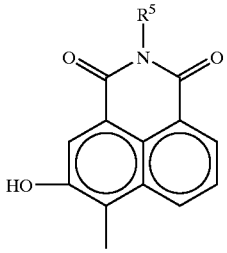

wherein $R^5$ represents a hydrogen atom, a substituted or unsubstituted alkyl group, or a substituted or unsubstituted aryl group;

(V)

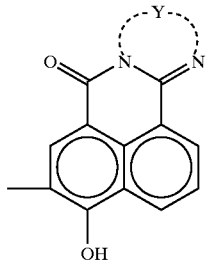

wherein Y represents a divalent aromatic hydrocarbon group or a divalent hetero ring including a nitrogen atom in the ring;

(VI)

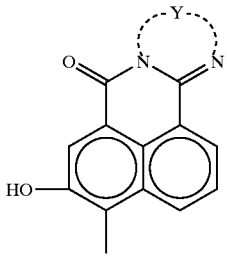

wherein Y represents a divalent aromatic hydrocarbon group or a divalent hetero ring including a nitrogen atom in the ring;

(VII)

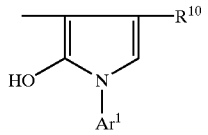

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group; and (VIII)

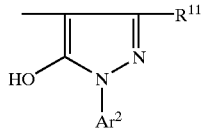

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group.

7. An electrophotographic photoreceptor comprising an intermediate layer located overlying an electroconductive substrate, a charge generation layer located overlying the intermediate layer and a charge transport layer located overlying the charge generation layer, wherein the charge generation layer satisfies the following relationship:

$T1 \leqq 3.5\%$ wherein T1 represents a relative mirror reflectance of the charge generation layer against a coherent light beam when the coherent light beam irradiates the charge generation layer at an incident angle of 5°.

8. The electrophotographic photoreceptor of claim 7, wherein the intermediate layer and the charge generation layer satisfy the following relationship:

$T1 \leqq T2 \leqq 3.5\%$ wherein T2 represents a relative mirror reflectance of the intermediate layer against the coherent light beam when the coherent light beam irradiates the intermediate layer at an incident angle of 5°.

9. The electrophotographic photoreceptor of claim 7, wherein the electroconductive substrate comprises a non-cut aluminum substrate.

10. The electrophotographic photoreceptor of claim 9, wherein said non-cut aluminum substrate is formed by a drawing process.

11. The electrophotographic photoreceptor of claim 7, wherein the charge generation layer comprises a disazo pigment having the following formula (I)

(I)

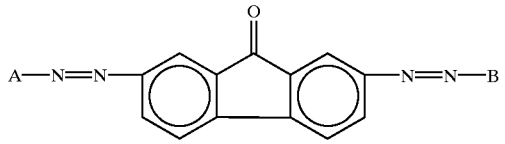

wherein A and B independently represent a coupler residual group having one of the following formulae (II) to (VIII);

(II)

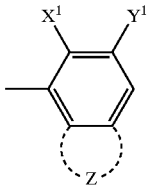

wherein $X^1$ represents —OH, —$NHCOCH_3$ or —$NHSO_2CH_3$; $Y^1$ represents —$CON(R^2)(R^3)$, —$CONHN{=}C(R^6)(R^7)$, —$CONHN(R^8)(R^9)$, —$CONHCONH(R^{12})$ a hydrogen atom, —COOH, —$COOCH_3$, $COOC_6H_5$ or a benzimidazolyl group, wherein $R^2$ and $R^3$ independently represent a hydrogen atom, a substituted or unsubstituted alkyl group, a substituted or unsubstituted aryl group and a substituted or unsubstituted hetero ring group; $R^2$ and $R^3$ optionally form a ring together with a nitrogen atom; $R^6$ and $R^7$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^6$ and $R^7$ optionally form a ring together with a carbon atom; $R^8$ and $R^9$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^8$ and $R^9$ optionally form a 5 or 6 membered ring, which optionally includes a condensed aromatic group; and $R^{12}$ represents a substituted or unsubstituted alkyl group, a substituted or unsubstituted aryl group and a substituted or unsubstituted hetero ring group; and Z represents a residual group selected from the group consisting of groups which are combined with the adjacent benzene ring to form a naphthalene ring, an anthracene ring, a carbazole ring, a benzocarbazole ring, a dibenzocarbazole ring, a dibenzofuran ring, a benzonaphthofuran ring and a dibenzothiophene ring; or a residual ring needed to form a hetero ring, which optionally have a substituted group;

(III)

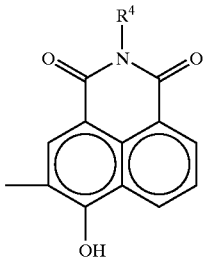

wherein $R^4$ represents a hydrogen atom, a substituted or unsubstituted alkyl group, or a substituted or unsubstituted aryl group;

(IV)

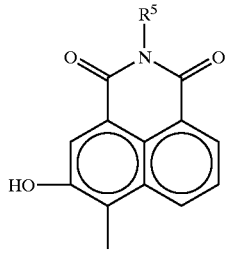

wherein $R^5$ represents a hydrogen atom, a substituted or unsubstituted alkyl group, or a substituted or unsubstituted aryl group;

(V)

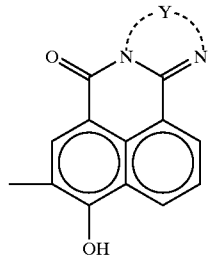

wherein Y represents a divalent aromatic hydrocarbon group or a divalent hetero ring including a nitrogen atom in the ring;

(VI)

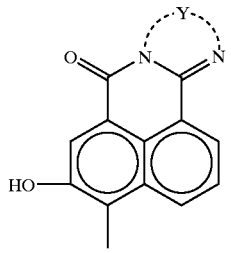

wherein Y represents a divalent aromatic hydrocarbon group or a divalent hetero ring including a nitrogen atom in the ring;

(VII)

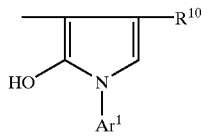

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group; and (VIII)

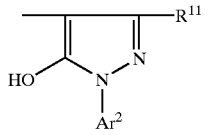

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group.

12. A process cartridge comprising:

a photoreceptor, and at least one member selected from the group consisting of:

a charger configured to charge the photoreceptor;

an image irradiator configured to irradiate the photoreceptor to form an electrostatic latent image thereon;

an image developer configured to develop the electrostatic latent image with a developer to form a toner image on the photoreceptor;

an image transferer configured to transfer the toner image onto a receiving material;

a cleaner configured to remove residual toner on the photoreceptor; and a discharger configured to discharge a residual potential of the photoreceptor, wherein the photoreceptor comprises an intermediate layer located overlying an electroconductive substrate, a charge generation layer located overlying the intermediate layer and a charge transport layer located overlying the charge generation layer, wherein the charge generation layer satisfies the following relationship:

$$T1 \leqq 3.5\%$$

wherein T1 represents a relative mirror reflectance of the charge generation layer against a coherent light beam when the coherent light beam irradiates the charge generation layer at an incident angle of 5°.

13. The process cartridge of claim 12, wherein the intermediate layer and the charge generation layer satisfy the following relationship:

$$T1 \leqq T2 \leqq 3.5\%$$

wherein T2 represents a relative mirror reflectance of the intermediate layer against the coherent light beam when the coherent light beam irradiates the intermediate layer at an incident angle of 5°.

14. The process cartridge of claim 12, wherein the electroconductive substrate comprises a non-cut aluminum substrate.

15. The process cartridge of claim 14, wherein the non-cut aluminum substrate is formed by a drawing process.

16. The process cartridge of claim 12, wherein the charge generation layer comprises a disazo pigment having the following formula (I):

(I)

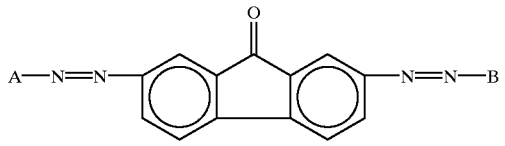

wherein A and B independently represent a coupler residual group having one of the following formulae (II) to (VIII);

(II)

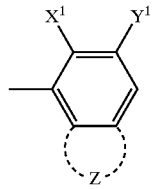

wherein $X^1$ represents —OH, —$NHCOCH_3$ or —$NHSO_2CH_3$; $Y^1$ represents —$CON(R^2)(R^3)$, —$CONHN{=}C(R^6)(R^7)$, —$CONHN(R^8)(R^9)$, —$CONHCONH(R^{12})$, a hydrogen atom, —COOH, —$COOCH_3$, $COOC_6H_5$ or a benzimidazolyl group, wherein $R^2$ and $R^3$ independently represent a hydrogen atom, a substituted or unsubstituted alkyl group, a substituted or unsubstituted aryl group and a substituted or unsubstituted hetero ring group; $R^2$ and $R^3$ optionally form a ring together with a nitrogen atom; $R^6$ and $R^7$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^6$ and $R^7$ optionally form a ring together with a carbon atom; $R^8$ and $R^9$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^8$ and $R^9$ optionally form a 5 or 6 membered ring, which optionally includes a condensed aromatic group; and $R^{12}$ represents a substituted or unsubstituted alkyl group, a substituted or unsubstituted aryl group and a substituted or unsubstituted hetero ring group; and Z represents a residual group selected from the group consisting of groups which are combined with the adjacent benzene ring to form a naphthalene ring, an anthracene ring, a carbazole ring, a benzocarbazole ring, a dibenzocarbazole ring, a dibenzofuran ring, a benzonaphthofuran ring and a dibenzothiophene ring; or a residual ring needed to form a hetero ring, which optionally have a substituted group;

(III)

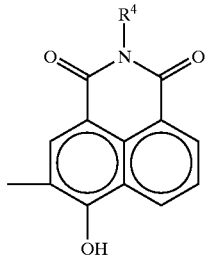

wherein $R^4$ represents a hydrogen atom, a substituted or unsubstituted alkyl group, or a substituted or unsubstituted aryl group;

(IV)

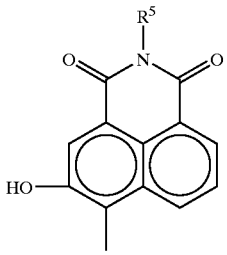

wherein $R^5$ represents a hydrogen atom, a substituted or unsubstituted alkyl group, or a substituted or unsubstituted aryl group;

(V)

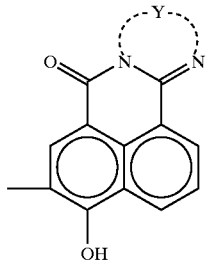

wherein Y represents a divalent aromatic hydrocarbon group or a divalent hetero ring including a nitrogen atom in the ring;

(VI)

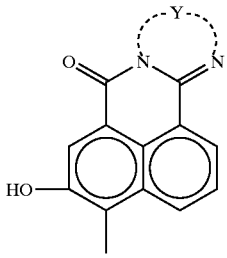

wherein Y represents a divalent aromatic hydrocarbon group or a divalent hetero ring including a nitrogen atom in the ring;

(VII)

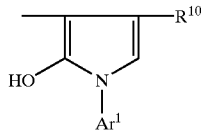

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group; and (VIII)

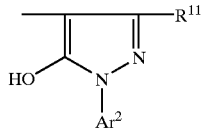

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group.

17. An electrophotographic image forming method comprising;

irradiating a photoreceptor with coherent light to form an electrostatic latent image thereon; and developing the electrostatic latent image with a developer, wherein the photoreceptor comprises an intermediate layer located overlying an electroconductive substrate, a charge generation layer located overlying the intermediate layer and a charge transport layer located overlying the charge generation layer, wherein the charge generation layer satisfies the following relationship:

$$T1 \leqq 3.5\%$$

wherein T1 represents a relative mirror reflectance of the charge generation layer against the coherent light beam when the coherent light beam irradiates the charge generation layer at an incident angle of 5°.

18. The electrophotographic image forming method of claim 17, wherein the intermediate layer and the charge generation layer satisfy the following relationship:

$$T1 \leqq T2 \leqq 3.5\%$$

wherein T2 represents a relative mirror reflectance of the intermediate layer against the coherent light beam when the coherent light beam irradiates the intermediate layer at an incident angle of 5°.

19. The electrophotographic image forming method of claim 17, wherein the electroconductive substrate comprises a non-cut aluminum substrate.

20. The electrophotographic image forming method of claim 19, wherein the non-cut aluminum substrate is formed by a drawing process.

21. The electrophotographic image forming method of claim 17, wherein the charge generation layer comprises a disazo pigment having the following formula (I)

(I)

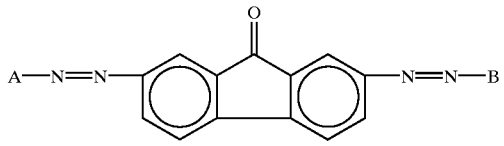

wherein A and B independently represent a coupler residual group having one of the following formulae (II) to (VIII);

(II)

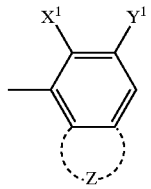

wherein $X^1$ represents —OH, —$NHCOCH_3$ or —$NHSO_2CH_3$; $Y^1$ represents —$CON(R^2)(R^3)$, —$CONHN{=}C(R^6)(R^7)$, —$CONHN(R^8)(R^9)$, —$CONHCONH(R^{12})$, a hydrogen atom, —COOH, —$COOCH_3$, $COC_6H_5$ or a benzimidazolyl group, wherein $R^2$ and $R^3$ independently represent a hydrogen atom, a substituted or unsubstituted alkyl group, a substituted or unsubstituted aryl group and a substituted or unsubstituted hetero ring group; $R^2$ and $R^3$ optionally form a ring together with a nitrogen atom; $R^6$ and $R^7$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^6$ and $R^7$ optionally form a ring together with a carbon atom; $R^8$ and $R^9$ independently represent a hydrogen atom, a substituted or unsubstituted alkyl group, a substituted or unsubstituted aralkyl group, a substituted or unsubstituted aryl group, a substituted or unsubstituted styryl group and a substituted or unsubstituted hetero ring group; $R^8$ and $R^9$ optionally form a 5 or 6 membered ring, which optionally includes a condensed aromatic group; and $R^{12}$ represents a substituted or unsubstituted alkyl group, a substituted or unsubstituted aryl group and a substituted or unsubstituted hetero ring group; and Z represents a residual group selected from the group consisting of groups which are combined with the adjacent benzene ring to form a naphthalene ring, an anthracene ring, a carbazole ring, a benzocarbazole ring, a dibenzocarbazole ring, a dibenzofuran ring, a benzonaphthofuran ring and a dibenzothiophene ring; or a residual ring needed to form a hetero ring, which optionally have a substituted group;

(III)

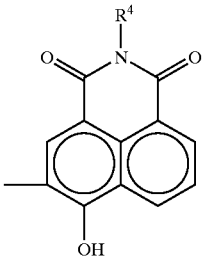

wherein $R^4$ represents a hydrogen atom, a substituted or unsubstituted alkyl group, or a substituted or unsubstituted aryl group;

(IV)

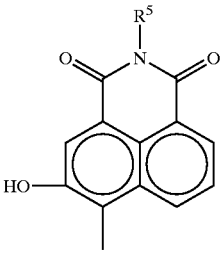

wherein $R^5$ represents a hydrogen atom, a substituted or unsubstituted alkyl group, or a substituted or unsubstituted aryl group;

(V)

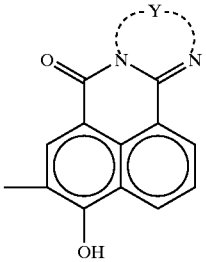

wherein Y represents a divalent aromatic hydrocarbon group or a divalent hetero ring including a nitrogen atom in the ring;

(VI)

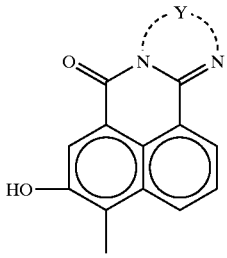

wherein Y represents a divalent aromatic hydrocarbon group or a divalent hetero ring including a nitrogen atom in the ring;

(VII)

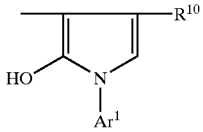

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group; and (VIII)

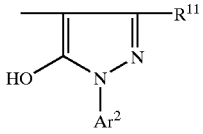

wherein $R^{10}$ represents a hydrogen atom, a lower alkyl group having 1 to 6 carbon atoms, a carboxyl group or an ester of a carboxyl group; and $Ar^1$ represents a substituted or unsubstituted aromatic hydrocarbon ring group.

* * * * *